US008182133B1

(12) United States Patent
Hockmeyer et al.

(10) Patent No.: US 8,182,133 B1
(45) Date of Patent: May 22, 2012

(54) MIXING BLADE ASSEMBLY WITH REVERSIBLE SCRAPERS AND METHOD

(75) Inventors: Herman H. Hockmeyer, Saddle River, NJ (US); Barry W. Cullens, Elizabeth City, NC (US); Matthew S. O'Kelley, Edenton, NC (US)

(73) Assignee: Hockmeyer Equipment Corp., Harrison, NJ (US)

( * ) Notice: Subject to any disclaimer, the term of this patent is extended or adjusted under 35 U.S.C. 154(b) by 0 days.

(21) Appl. No.: 13/313,314

(22) Filed: Dec. 7, 2011

(51) Int. Cl.
*B01F 7/24* (2006.01)

(52) U.S. Cl. ..... 366/149; 366/310; 366/311; 366/312

(58) Field of Classification Search ..... 366/149, 366/310–312
See application file for complete search history.

(56) References Cited

U.S. PATENT DOCUMENTS

| | | | | |
|---|---|---|---|---|
| 864,631 | A * | 8/1907 | Fegley | 366/311 |
| 864,632 | A * | 8/1907 | Fegley | 366/311 |
| 1,369,053 | A * | 2/1921 | Scott | 366/204 |
| 5,549,384 | A | 8/1996 | Reynolds | |
| 7,175,118 | B2 | 2/2007 | Hockmeyer | |
| 7,914,200 | B1 | 3/2011 | Hockmeyer et al. | |

* cited by examiner

*Primary Examiner* — David Sorkin
(74) *Attorney, Agent, or Firm* — Arthur Jacob

(57) ABSTRACT

A mixing apparatus and method mixes constituents of a feedstock in a vessel, utilizing a mixing blade assembly rotated within the vessel in forward and reverse directions. The feedstock engages walls of the vessel, and scraper blades are carried by the mixing blade assembly to scrape feedstock from the walls of the vessel and direct scraped feedstock to feedstock being circulated within the vessel during rotation of the mixing blade assembly in either the forward direction or the reverse direction. The scraper blades each include scraper edges and are coupled to the mixing blade assembly for pivotal movement in response to engagement with feedstock during mixing, so as to juxtapose one or the other of opposite scraper edges of each scraper blade with the vessel wall for scraping feedstock during rotation of the mixing blade assembly in both the forward and reverse directions.

24 Claims, 14 Drawing Sheets

MIXING BLADE ASSEMBLY WITH REVERSIBLE SCRAPERS AND METHOD

The present invention relates generally to apparatus and method for mixing liquids and, in particular, feedstock in the form of viscous liquids containing solid constituents, and pertains, more specifically, to scraping such a feedstock from wall surfaces within a vessel containing the feedstock during a mixing operation in order to enhance mixing of the constituents of the feedstock and attain greater uniformity within a reduced mixing time.

Conventional mixing machines commonly employ mixing blades which confront and move across corresponding wall surfaces in a vessel within which a feedstock is contained while being mixed so as to facilitate mixing of the constituents of the feedstock, as well as the conduct of heat between the feedstock and these wall surfaces of the vessel. For example, in a typical mixing apparatus, a mixing blade constructed in the form of a helix is rotated within a vessel having a circular cylindrical side wall extending upwardly from a complementary circular bottom wall, the mixing blade being carried by a support structure having a horizontal support member that sweeps across the bottom wall and a vertical support member that sweeps across the side wall, while the feedstock is circulated within the vessel toward and away from the walls of the vessel by the helical mixing blade. The horizontal and vertical support members carry scrapers which engage corresponding walls of the vessel to scrape feedstock from the walls as the support members sweep past respective walls; however, the support members themselves play little or no part in moving the feedstock toward or away from the walls of the vessel to effect the desired mixing, as well as heat transfer during a mixing operation.

In U.S. Pat. No. 7,914,200, the disclosure of which is incorporated herein by reference thereto, a construction is shown in which the support structure that carries the mixing blade works in concert with the mixing blade to attain better heat transfer between the feedstock and the walls of the vessel, with a concomitant increase in uniformity gained throughout the feedstock in less mixing time.

The present invention provides an improvement that attains increased effectiveness and efficiency in mixing, as well as enhanced heat transfer, through effecting scraping of the feedstock from the walls of the vessel during both a forward movement and a reverse movement of the support members as the support members sweep past the respective walls. As such, the present invention attains several objects and advantages, some of which are summarized as follows: Provides a mixing blade assembly placed within a mixing vessel and carrying scraper blades that effect scraping of feedstock from walls of the mixing vessel during movement of the mixing blade assembly, and the scraper blades, in both a forward direction and a reverse direction to increase the effectiveness of the mixing blade assembly in mixing a batch of feedstock in the mixing vessel; facilitates heat transfer between a batch of feedstock and the walls of the vessel within which the feedstock is mixed, for attaining increased uniformity throughout the batch in less mixing time; reduces resistance to efficient circulation of feedstock within a batch of feedstock being mixed in a mixing vessel, with a concomitant reduction of energy needed to complete a mixing operation; provides a mixing blade assembly placed within a mixing vessel with an additional mixing mechanism, which mixing blade assembly is constructed to interact with the additional mixing mechanism to assist in circulating feedstock within the batch for increased effectiveness of both the mixing blade assembly and the additional mixing mechanism; attains a more uniform mixture within a batch of feedstock in less time and with the consumption of less energy; simplifies the maintenance of a mixing blade assembly for economical long-term operation; provides a rugged mixing blade assembly capable of exemplary performance over an extended service life.

The above objects and advantages, as well as further objects and advantages, are attained by the present invention which may be described briefly as a mixing apparatus for mixing constituents of a feedstock, the mixing apparatus comprising: a vessel including a wall surface within the vessel for being engaged by the feedstock as the constituents of the feedstock are mixed within the vessel; a mixing blade assembly including a mixing blade, the mixing blade assembly being adapted to move within the vessel in either one of a forward direction and a reverse direction wherein the mixing blade will circulate feedstock within the vessel; and a scraper blade carried by the mixing blade assembly for sweeping of the scraper blade along a path of travel extending in juxtaposition with the wall surface as the mixing blade assembly is moved in either one of the forward and reverse directions, the scraper blade having opposite first and second scraper edges and being mounted upon the mixing blade assembly for movement relative to the mixing blade assembly, the scraper blade being configured such that upon movement of the mixing blade assembly in the forward direction, the scraper blade will sweep along the path of travel and will be moved relative to the mixing blade assembly, in response to engagement with feedstock, into a first position wherein the first scraper edge of the scraper blade is juxtaposed with the wall surface to scrape feedstock material from the wall surface for direction of scraped feedstock material by the scraper blade to feedstock being circulated by the mixing blade, and upon movement of the mixing blade assembly in the reverse direction, the scraper blade will sweep along the path of travel and will be moved relative to the mixing blade assembly, in response to engagement with feedstock, into a second position wherein the second scraper edge of the scraper blade is juxtaposed with the wall surface to scrape feedstock material from the wall surface for direction of scraped feedstock material by the scraper blade to feedstock being circulated by the mixing blade.

In addition, the present invention provides a mixing apparatus for mixing constituents of a feedstock, the mixing apparatus comprising: a vessel for containing feedstock, the vessel having a vessel wall, the vessel wall including a side wall and an end wall, a side wall surface extending along the side wall for being engaged by the feedstock as the constituents of the feedstock are mixed within the vessel, and an end wall surface extending along the end wall for being engaged by the feedstock as the constituents of the feedstock are mixed within the vessel; a mixing blade assembly including a mixing blade, the mixing blade assembly being adapted to move within the vessel in either one of a forward direction and a reverse direction wherein the mixing blade will circulate feedstock within the vessel; a side scraper blade carried by the mixing blade assembly for sweeping along a side path of travel extending in juxtaposition with the side wall surface, the side scraper blade having opposite first and second side scraper edges and being mounted upon the mixing blade assembly for movement relative to the side mixing blade assembly, the side scraper blade being configured such that upon sweeping of the side scraper blade along the side path of travel in the forward direction, the side scraper blade will be moved relative to the mixing blade assembly, in response to engagement with feedstock, into a first position wherein the first side scraper edge of the side scraper blade is juxtaposed with the side wall surface to scrape feedstock material from the side wall surface for direction of scraped feedstock material by the side scraper blade to feedstock being circulated by the mixing blade, and upon sweeping of the side scraper blade along the side path of travel in the reverse direction, the side scraper blade will be moved relative to the mixing blade assembly, in response to engagement by feedstock into a second position wherein the second side scraper edge of the side scraper blade is juxtaposed with the side wall surface to scrape feedstock material from the side wall surface for direction of scraped feedstock material by the side scraper blade to feedstock being circulated by the mixing blade; and an end scraper blade carried by the mixing blade assembly for sweeping along an end path of travel extending in juxtaposition with the end wall surface, the end scraper blade having opposite first and second end scraper edges and being mounted upon the mixing blade assembly for movement relative to the mixing blade assembly, the end scraper blade being configured such that upon movement of the mixing blade assembly in the forward direction, the end scraper blade will be moved relative to the mixing blade assembly, in response to engagement with feedstock, into a first position wherein the first end scraper edge of the end scraper blade is juxtaposed with the end wall surface to scrape feedstock material from the end wall surface for direction of scraped feedstock material by the end scraper blade to feedstock being circulated by the mixing blade, and upon movement of the mixing blade assembly in the reverse direction, the end scraper blade will be moved relative to the mixing blade assembly, in response to engagement with feedstock, into a second position wherein the second end scraper edge of the end scraper blade is juxtaposed with the end wall surface to scrape feedstock material from the end wall surface for direction of scraped feedstock material by the end scraper blade to feedstock being circulated by the mixing blade.

Further, the present invention includes a mixing apparatus for mixing constituents of a feedstock, the mixing apparatus comprising: a vessel for containing feedstock, the vessel having a vessel wall, the vessel wall including a side wall and an end wall, a side wall surface extending along the side wall for being engaged by the feedstock as the constituents of the feedstock are mixed within the vessel, and an end wall surface extending along the end wall for being engaged by the feedstock as the constituents of the feedstock are mixed within the vessel; a mixing blade assembly including a mixing blade, the mixing blade assembly being adapted to rotate within the vessel, about an axis of rotation, in either one of a forward direction of rotation and a reverse direction or rotation, wherein the mixing blade will circulate feedstock within the vessel, the mixing blade assembly including an end mixing blade support member spaced from the end wall surface and extending along a radial direction between the axis of rotation and the side wall; and an end scraper blade carried by the end mixing blade support member, between the end mixing blade support member and the end wall surface, for sweeping along an end path of travel extending in juxtaposition with the end wall surface, the end scraper blade having opposite first and second end scraper edges and being mounted upon the mixing blade assembly for movement relative to the mixing blade assembly, the end scraper blade being configured such that upon rotation of the mixing blade assembly in the forward direction of rotation, the end scraper blade will be moved relative to the mixing blade assembly, in response to engagement with feedstock, into a first position wherein the first end scraper edge of the end scraper blade is juxtaposed with the end wall surface to scrape feedstock material from the end wall surface for direction of scraped feedstock material by the end scraper blade to feedstock being circulated by the mixing blade, and upon rotation of the mixing blade assembly in the reverse direction of rotation, the end scraper blade will be moved relative to the mixing blade assembly, in response to engagement with feedstock, into a second position wherein the second end scraper edge of the end scraper blade is juxtaposed with the end wall surface to scrape feedstock material from the end wall surface for direction of scraped feedstock material by the end scraper blade to feedstock being circulated by the mixing blade.

Still further, the present invention presents a method for mixing constituents of a feedstock within a vessel wherein the feedstock is engaged with a wall surface within the vessel as the constituents of the feedstock are mixed within the vessel, the method comprising: moving a mixing blade assembly having a mixing blade within the vessel in either one of a forward direction and a reverse direction to circulate feedstock within the vessel; and coupling a scraper blade with the mixing blade assembly for sweeping the scraper blade along a path of travel extending in juxtaposition with the wall surface upon movement of the mixing blade assembly in either the forward and reverse directions, the scraper blade having opposite first and second scraper edges; the scraper blade being movable relative to the mixing blade assembly and being configured such that upon movement of the mixing blade assembly in the forward direction, the scraper blade is moved relative to the mixing blade assembly, in response to engagement with feedstock, into a first position wherein the first scraper edge of the scraper blade scrapes feedstock material from the wall surface for direction of scraped feedstock material by the scraper blade to feedstock being circulated by the mixing blade, and upon movement of the mixing blade assembly in the reverse direction, the scraper blade is moved relative too the mixing blade assembly, in response to engagement with feedstock, into a second position wherein the second scraper edge of the scraper blade scrapes feedstock material from the wall surface for direction of scraped feedstock material by the scraper blade to feedstock being circulated by the mixing blade.

The invention will be understood more fully, while still further objects and advantages will become apparent, in the following detailed description of preferred embodiments of the invention illustrated in the accompanying drawing, in which.

Figure 6:
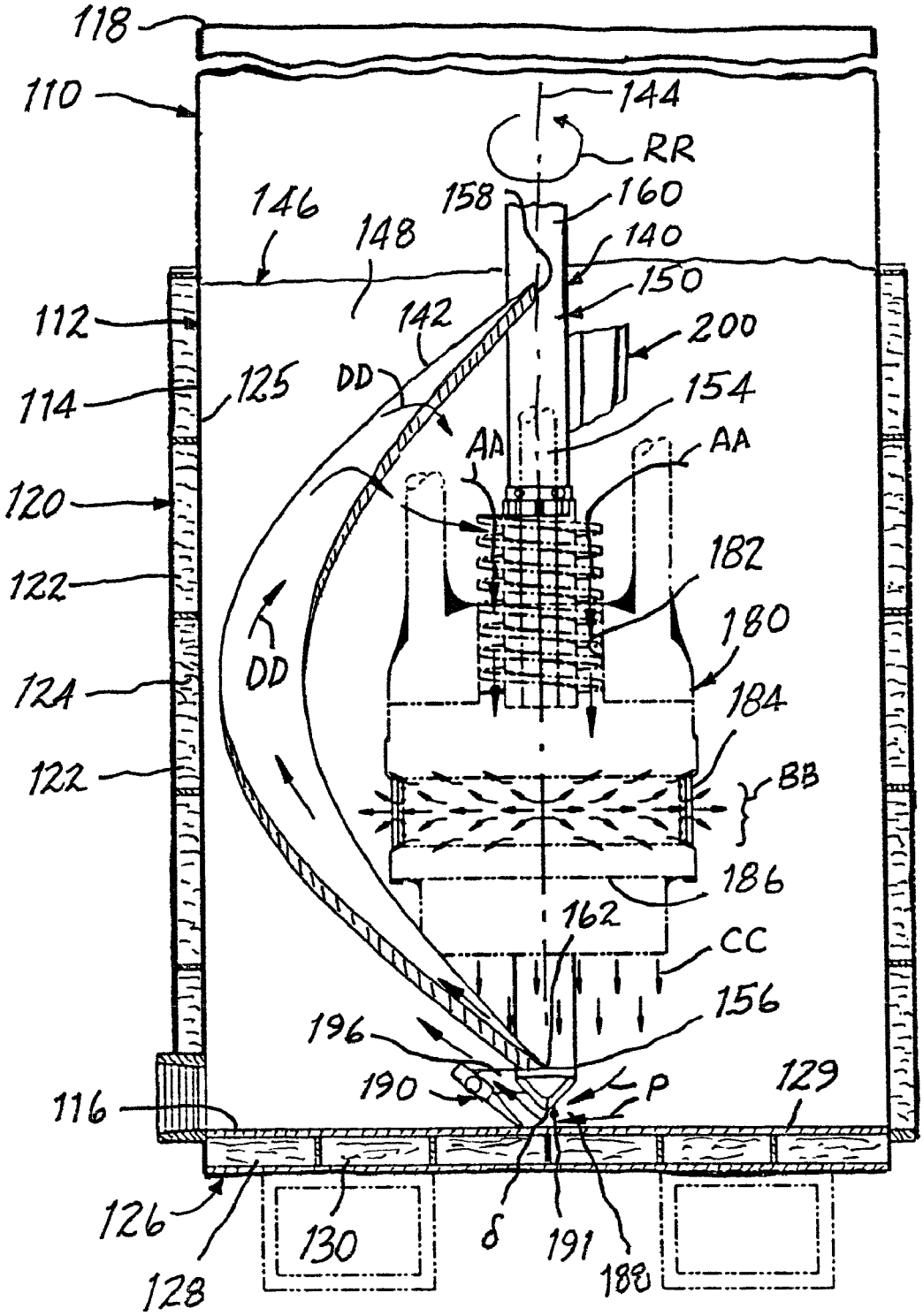
FIG. 6 PRIOR ART
Figure 7:
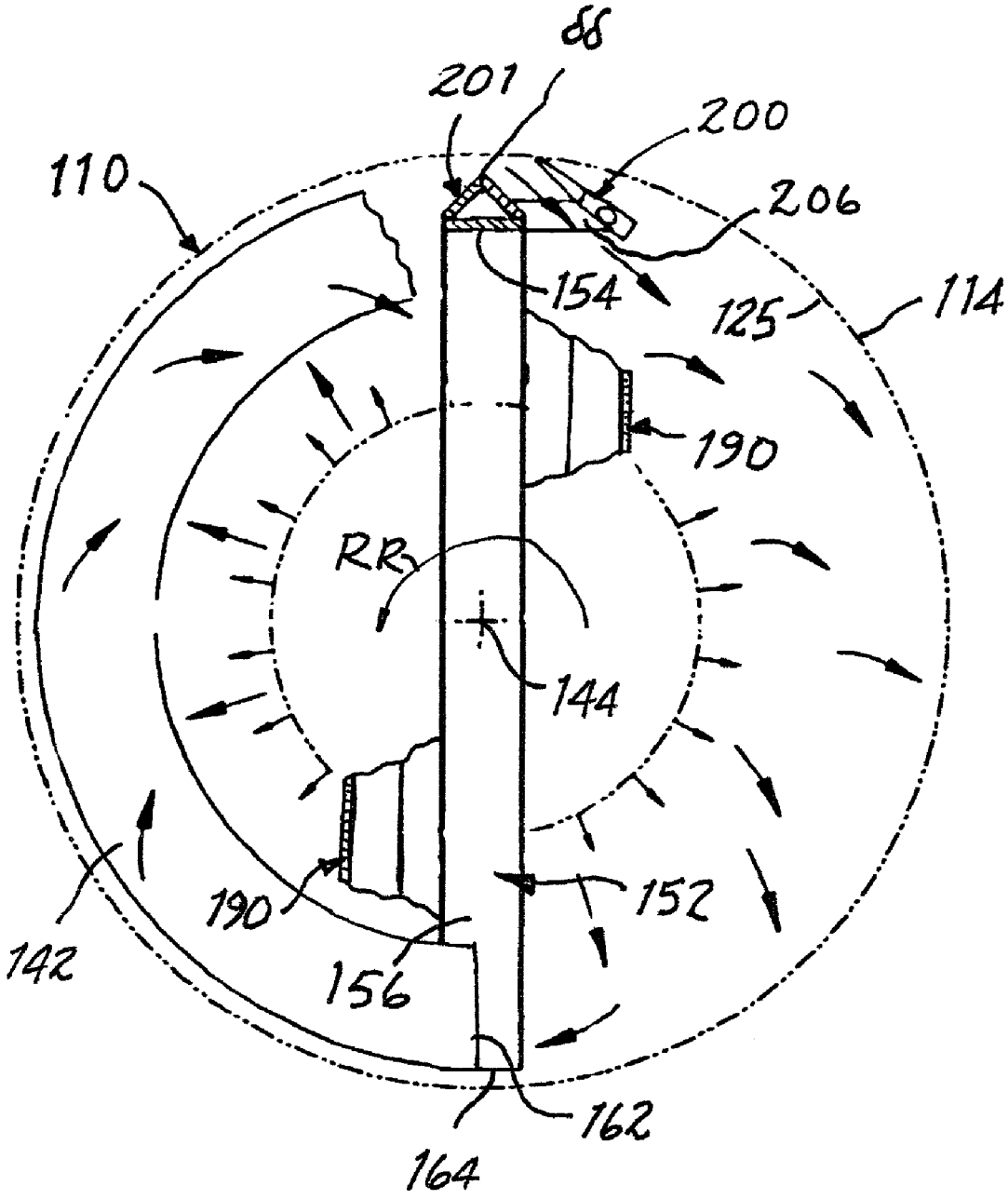
FIG. 7 PRIOR ART
Figure 8:
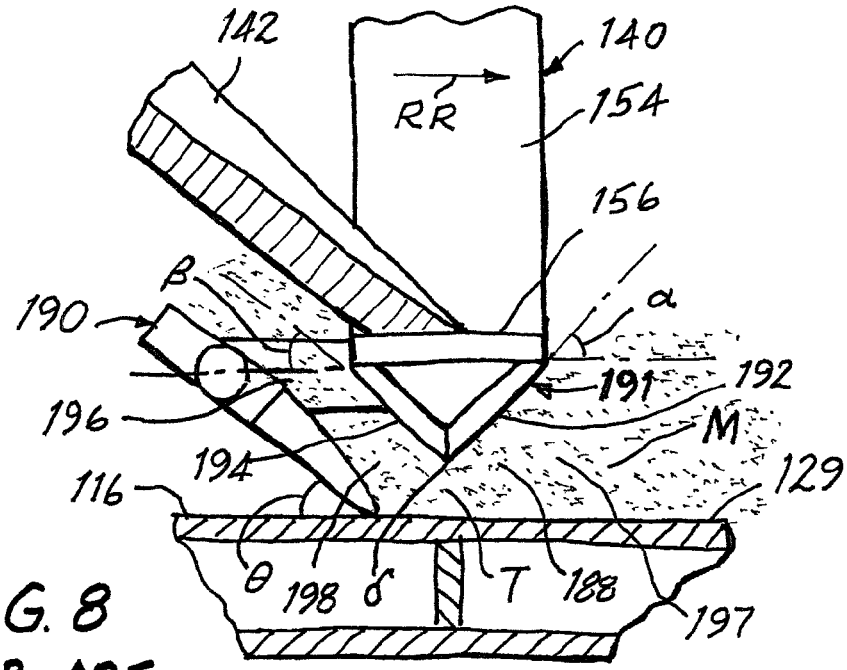
FIG. 8 PRIOR ART
Figure 9:
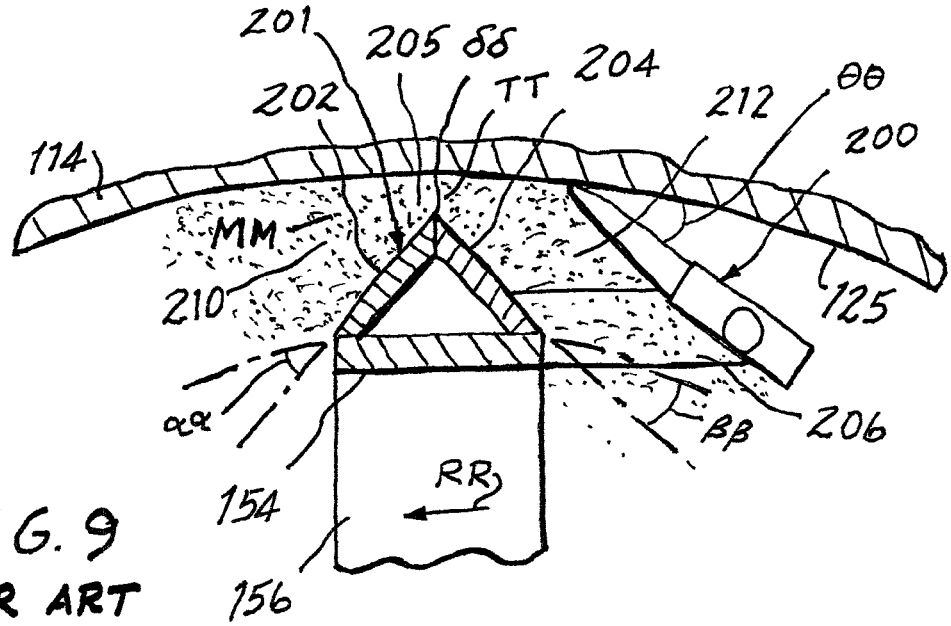
FIG. 9 PRIOR ART
Figure 10:
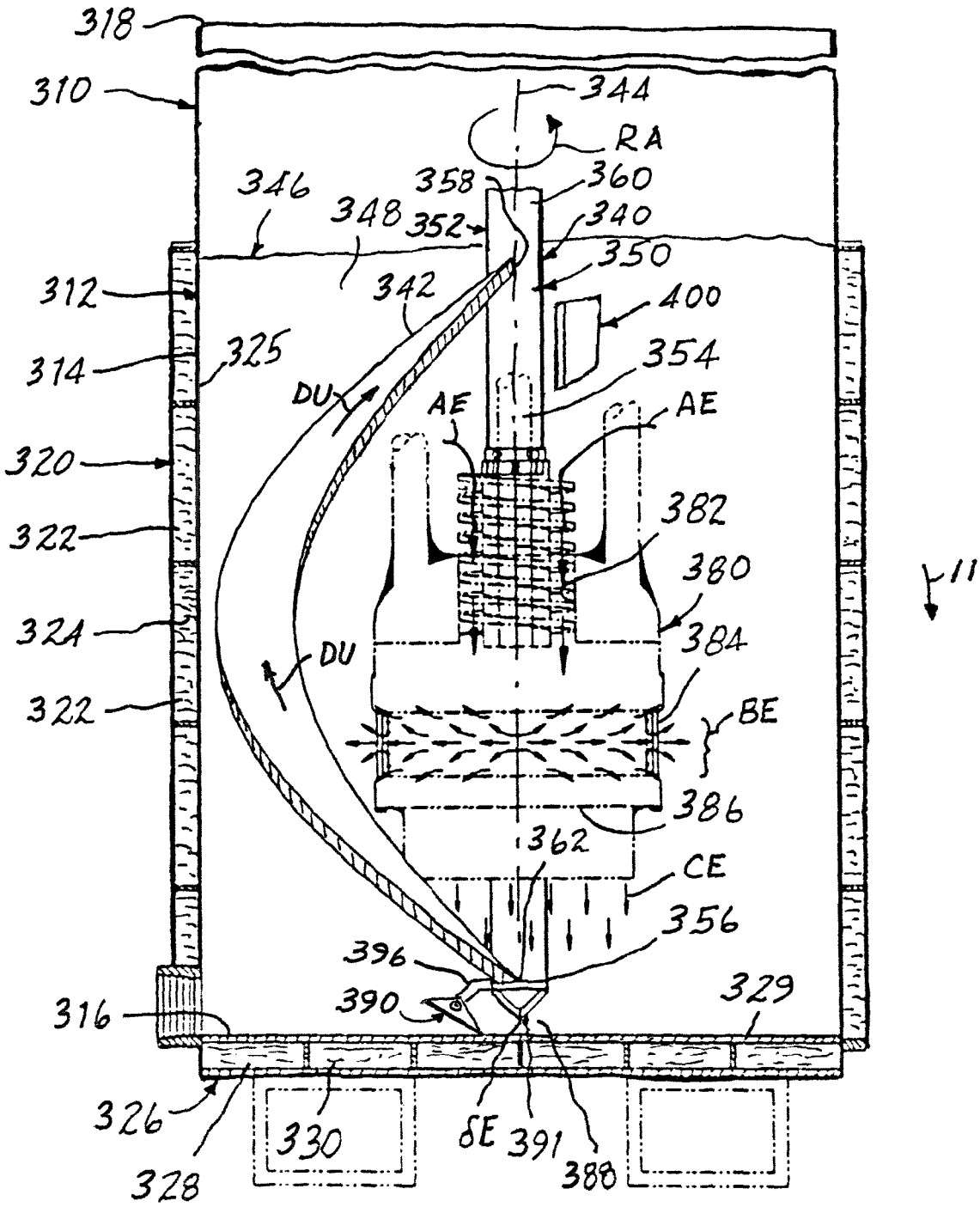
Figure 11:
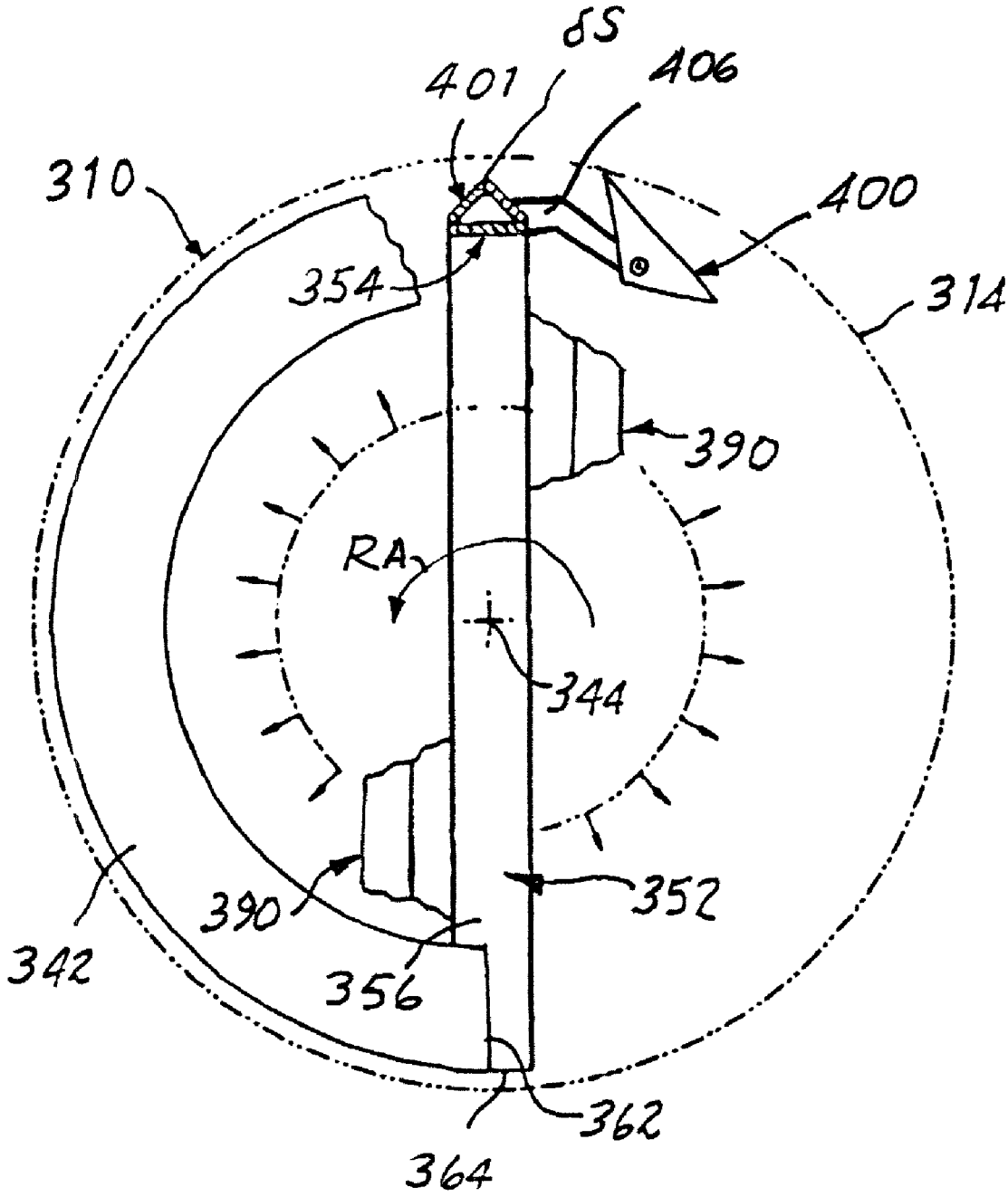
Figure 12:
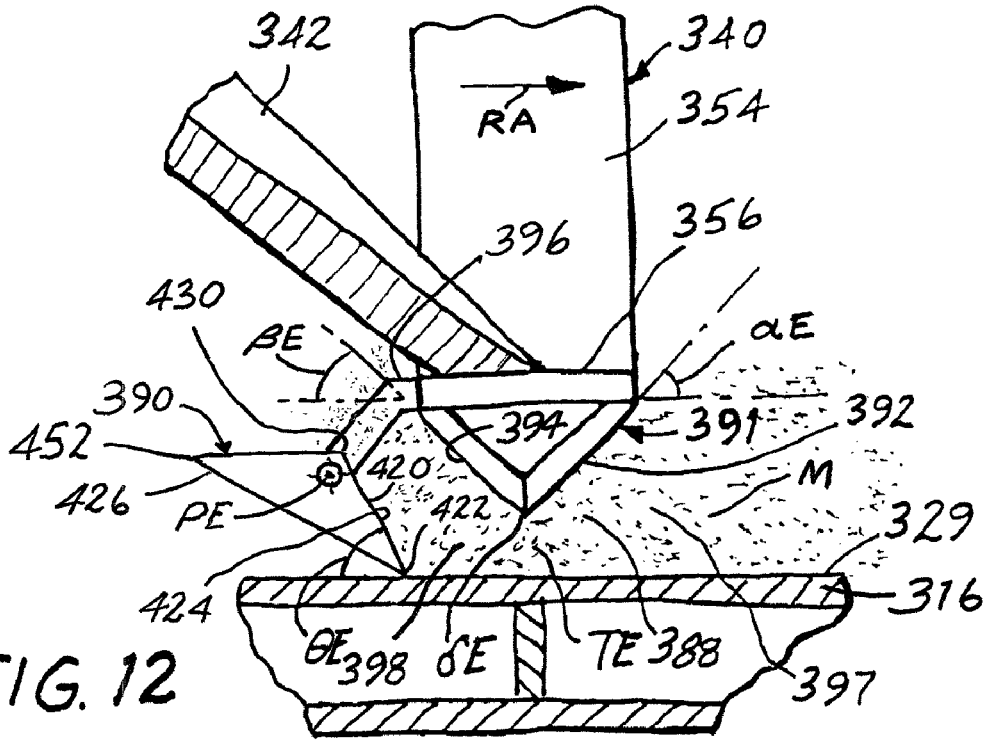
Figure 13:
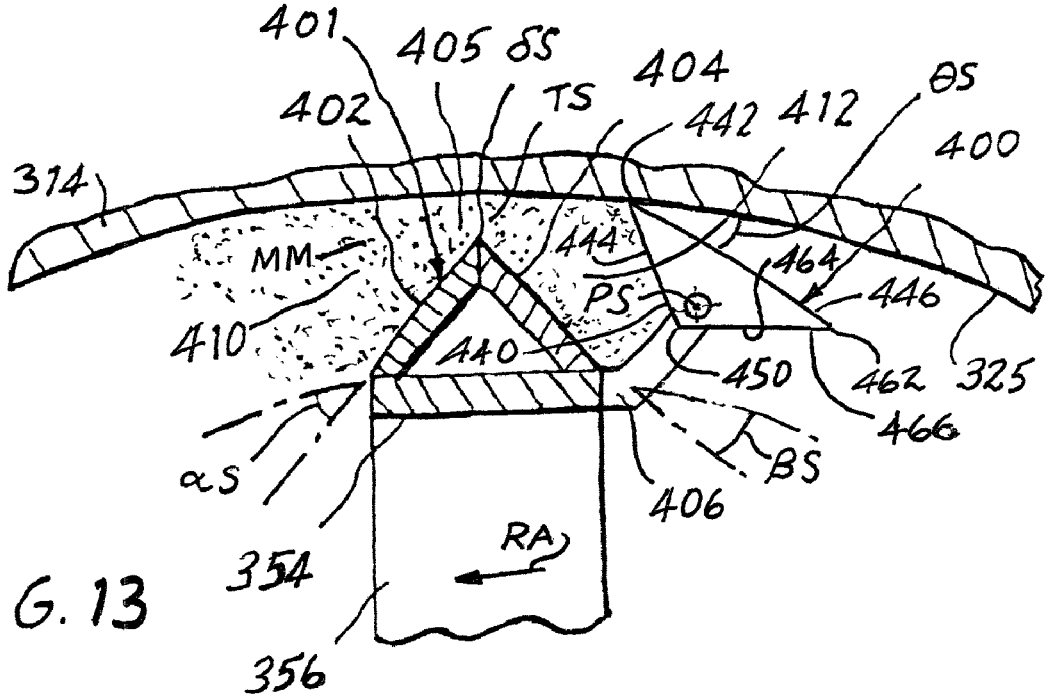
Figure 14:
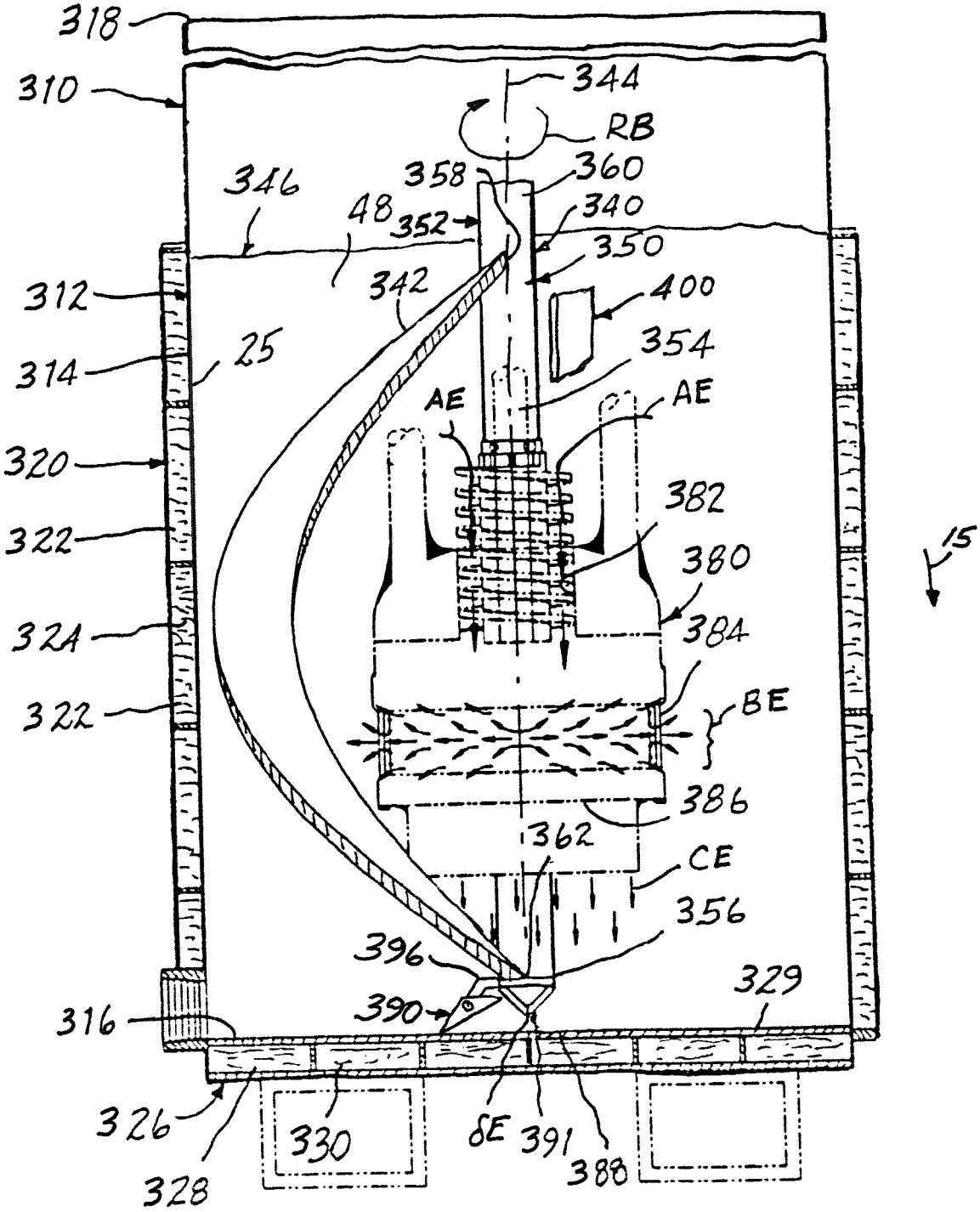
Figure 15:
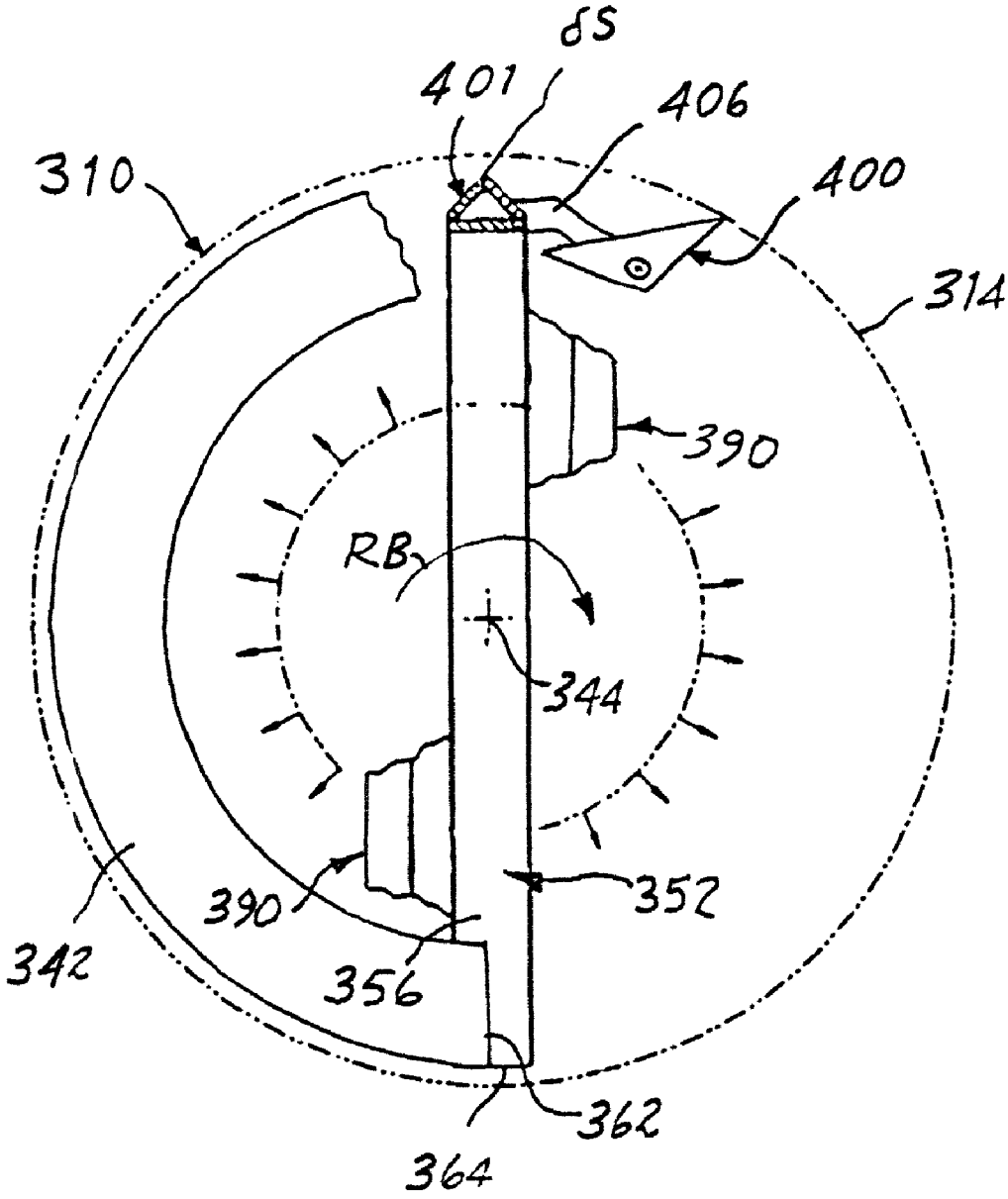
Figure 16:
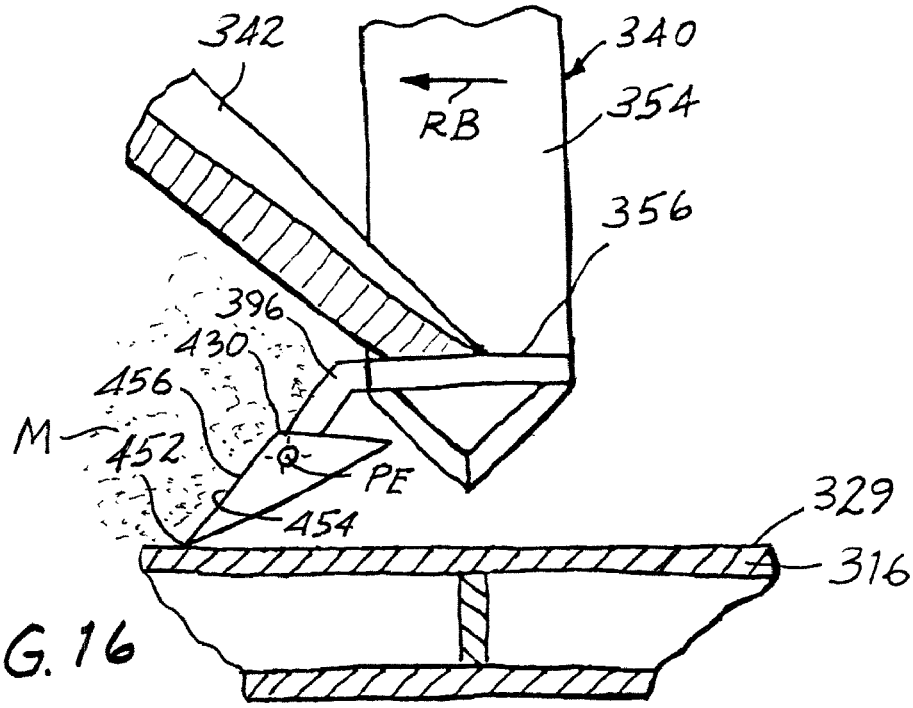
Figure 17:
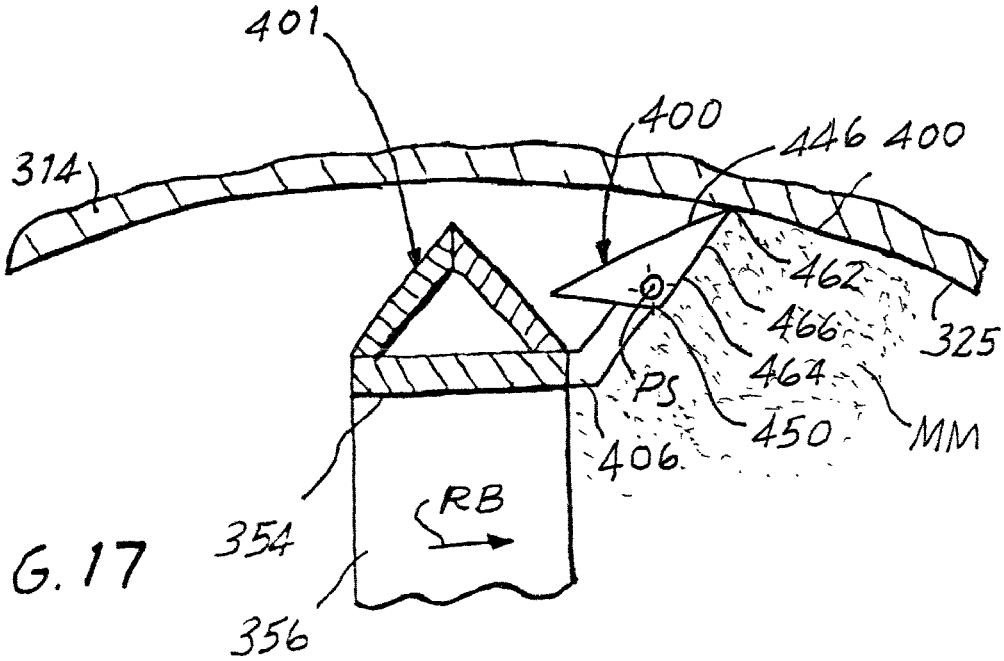
Figure 18:
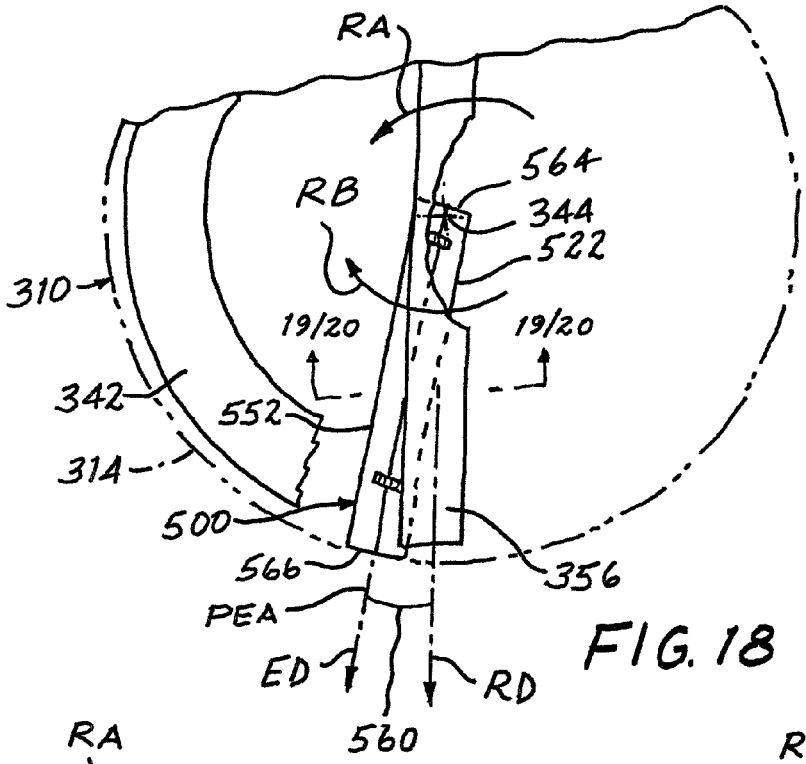
Figure 19:
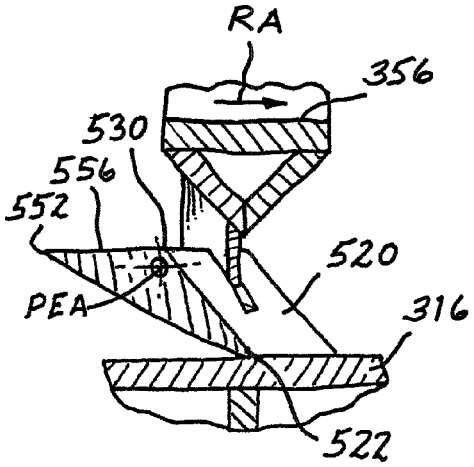
Figure 20:
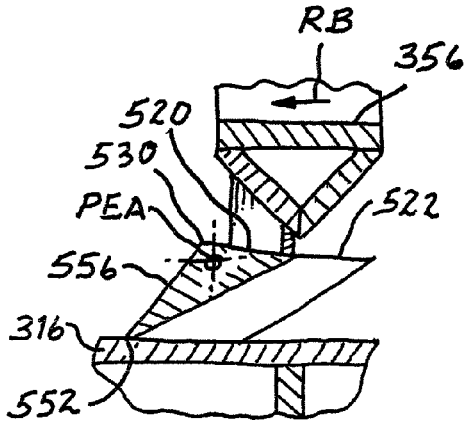

FIG. 6 is a somewhat diagrammatic, vertical cross-sectional view of another mixing apparatus constructed in accordance with the prior art, as disclosed in the aforesaid U.S. Pat. No. 7,914,200;

FIG. 7 is a somewhat diagrammatic, horizontal cross-sectional view of the apparatus of FIG. 6, taken in the direction of arrow 7 in FIG. 6;

FIG. 8 is an enlarged fragmentary cross-sectional view of a portion of FIG. 6;

FIG. 9 is an enlarged fragmentary cross-sectional view of a portion of FIG. 7;

FIG. 10 is a somewhat diagrammatic, vertical cross-sectional view of a mixing apparatus constructed in accordance with the present invention;

FIG. 11 is a somewhat diagrammatic, horizontal cross-sectional view of the apparatus of FIG. 10, taken in the direction of arrow 11 in FIG. 10;

FIG. 12 is an enlarged fragmentary cross-sectional view of a portion of FIG. 10;

FIG. 13 is an enlarged fragmentary cross-sectional view of a portion of FIG. 11;

FIG. 14 is somewhat diagrammatic, vertical cross-sectional view of the apparatus, similar to FIG. 10, and showing a different mode of operation;

FIG. 15 is a somewhat diagrammatic, horizontal cross-sectional view of the apparatus, taken in the direction of arrow 15 in FIG. 14;

FIG. 16 is an enlarged fragmentary cross-sectional view of a portion of FIG. 14;

FIG. 17 is an enlarged fragmentary cross-sectional view of a portion of FIG. 15;

FIG. 18 is a somewhat diagrammatic, fragmentary horizontal cross-sectional view similar to a portion of FIG. 15, and illustrating another embodiment constructed in accordance with the present invention;

FIG. 19 is an enlarged fragmentary cross-sectional view taken along line 19-19 of FIG. 18 during rotation of components of the apparatus in the direction RA in FIG. 18; and FIG. 20 is an enlarged fragmentary cross-sectional view taken along line 20-20 of FIG. 18 during rotation of components of the apparatus in the direction RB in FIG. 18.

Figure 1:
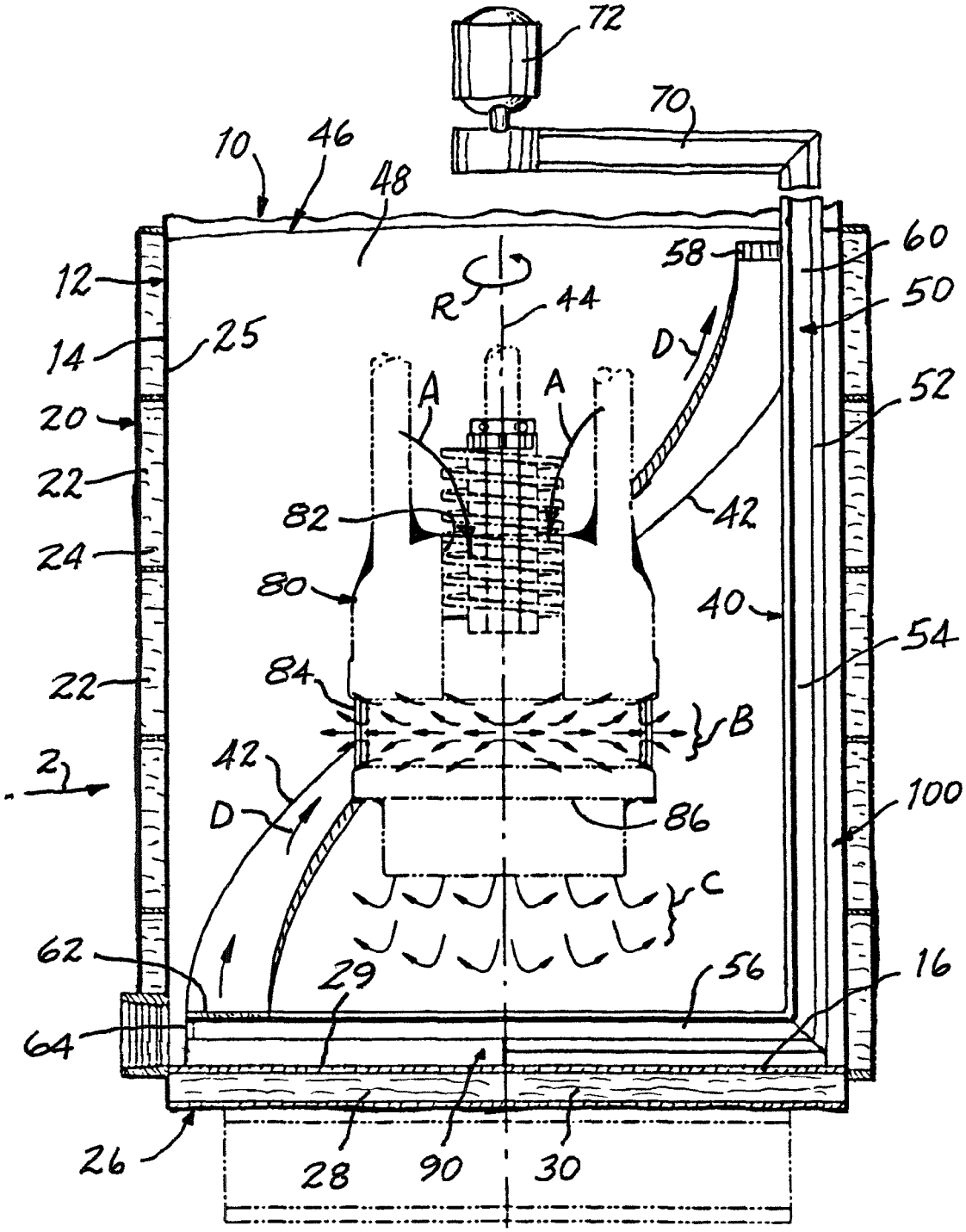
FIG. 1 PRIOR ART
FIG. 1 is a somewhat diagrammatic, vertical cross-sectional view of a mixing apparatus constructed in accordance with the prior art.
Figure 2:
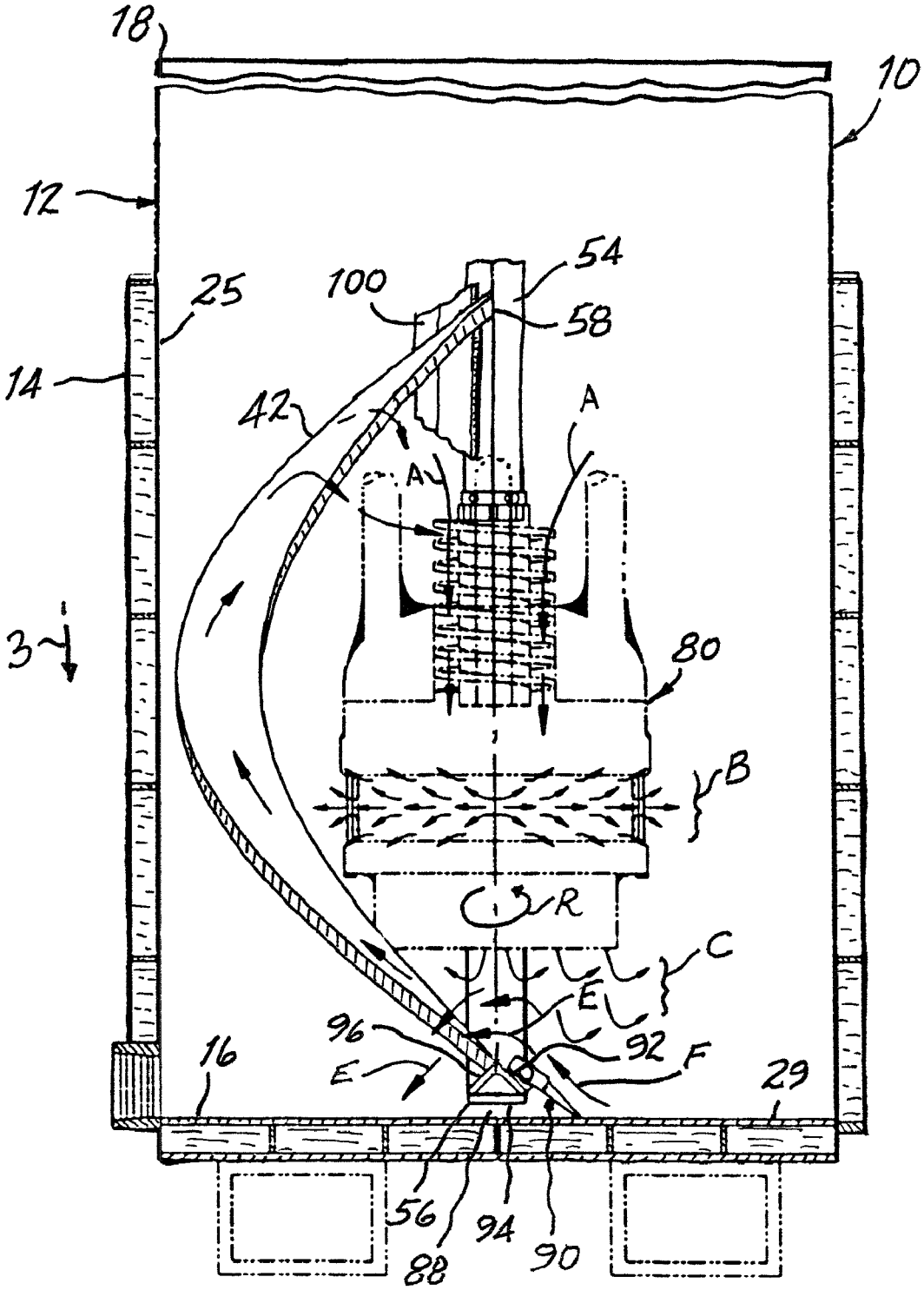
FIG. 2 PRIOR ART
FIG. 2 is a somewhat diagrammatic, vertical cross-sectional view of the apparatus, taken in the direction of arrow 2 in FIG. 1.
Figure 3:
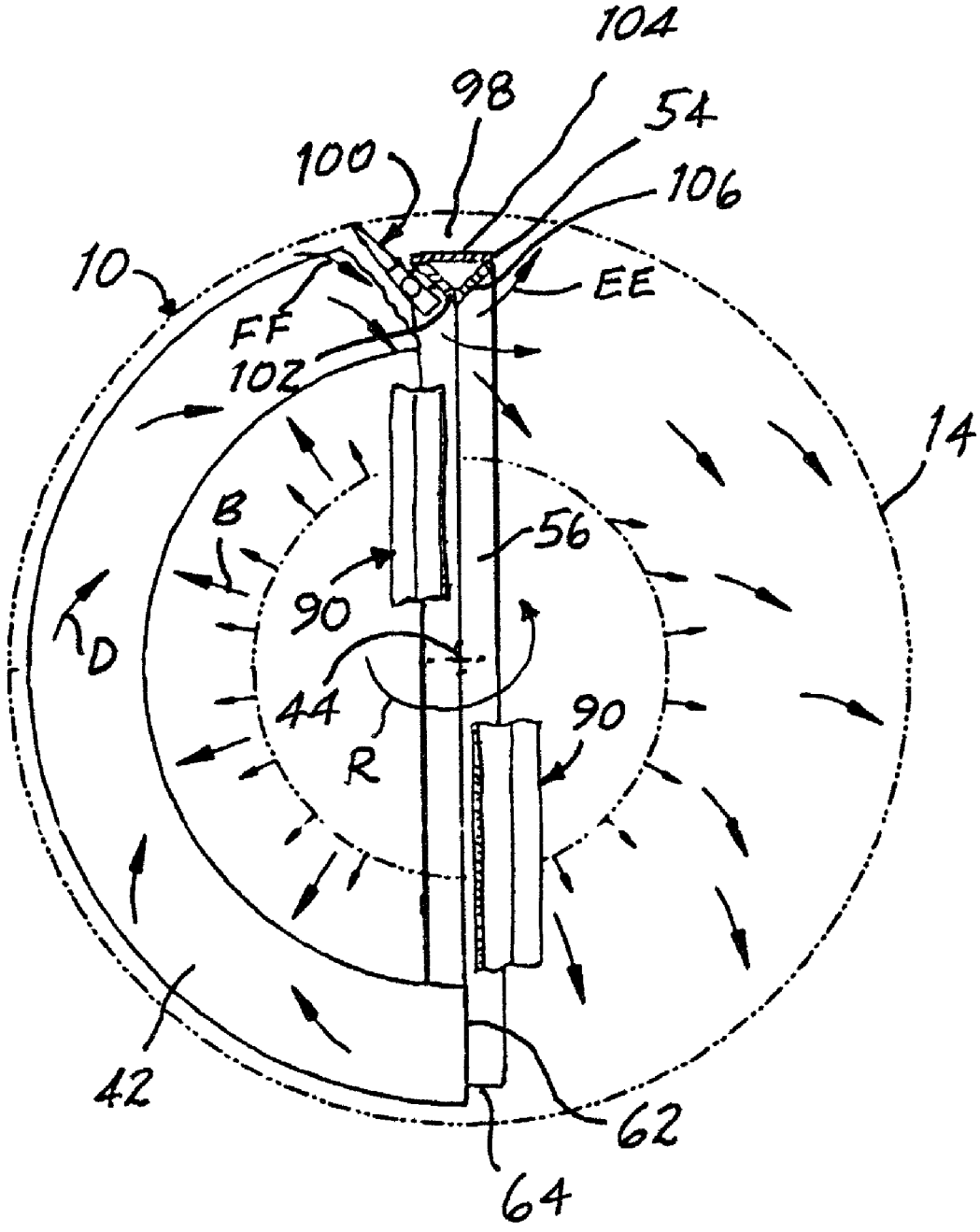
FIG. 3 PRIOR ART
FIG. 3 is a somewhat diagrammatic, horizontal cross-sectional view of the apparatus, taken in the direction of arrow 3 in FIG. 2.

Referring now to the drawing, and especially to FIGS. 1 through 3 thereof, a mixing apparatus constructed in accordance with the prior art is shown at 10 and is seen to include a vessel 12 having a circular cylindrical vertical side wall 14 extending upwardly from a circular horizontal bottom wall 16 to a top end 18. A cylindrical jacket 20 surrounds the side wall 14 and includes vertically arranged chambers 22 for circulating a heat transfer fluid 24 in juxtaposition with vertical side wall 14 and heat transfer surface 25 provided by side wall 14. A circular jacket 26 is juxtaposed with bottom wall 16 and includes horizontally arranged chambers 28 for circulating a heat transfer fluid 30 in juxtaposition with bottom wall 16 and heat transfer surface 29 provided by bottom wall 16.

A mixing blade assembly 40 includes a helical mixing blade 42 and is mounted for rotation within vessel 12, about a central axis of rotation 44, to rotate mixing blade 42 in a direction R about the central axis of rotation 44 and effect mixing of a batch 46 of feedstock 48 placed within vessel 12. Mixing blade 42 is juxtaposed with vertical side wall 14 and, upon rotation about axis of rotation 44, in the direction R, effects mixing of the feedstock 48 while driving the feedstock 48 generally upwardly, in a direction from the bottom wall 16 toward the top end 18 of the side wall 14 to circulate the feedstock 48 within the vessel 12.

Mixing blade 42 is carried by a support structure 50 of the mixing blade assembly 40, the support structure 50 including a generally L-shaped frame 52 comprised of a vertical support member 54 and a horizontal support member 56. The mixing blade 42 is affixed, adjacent upper end 58 of the mixing blade 42, to the frame 52, adjacent upper portion 60 of vertical support member 54, and is affixed, adjacent lower end 62 of the mixing blade 42, to the frame 52, adjacent end 64 of horizontal support member 56, as by welding the mixing blade 42 to the frame 52 at each end 58 and 62 of mixing blade 42. The frame 52 is affixed, adjacent upper portion 60 of vertical support member 54, to a drive member 70 which, in turn, is coupled to a drive motor 72 for effecting rotation of the frame 52. An additional mixing mechanism is placed within vessel 12, and is shown in the form of a submersible media mill 80 located coaxial with mixing blade assembly 40 and mixing blade 42, the media mill 80 having an inlet at 82 and outlets at an apertured containment wall 84 and at an apertured bottom 86, as is conventional in media mills.

In the operation of mixing apparatus 10, mixing blade assembly 40 is rotated simultaneously with the operation of media mill 80, and feedstock 48 is circulated within vessel 12. Thus, feedstock 48 enters media mill 80 at inlet 82, as indicated by arrows A, is processed by the media mill 80 and exits through containment wall 84 and bottom 86, directed generally toward the side wall 14, as indicated by arrows B, and toward the bottom wall 16 of the vessel 12, as indicated by arrows C. Helical mixing blade 42 moves the feedstock 48 upwardly, as indicated by arrows D, to once again enter the media mill 80 at inlet 82, again as indicated by arrows A.

Usually, feedstock 48 consists of a viscous liquid which contains solid constituents and tends to accumulate along the side wall 14 and the bottom wall 16 of vessel 12, at the respective heat transfer surfaces 25 and 29. In order to facilitate the transfer of heat between the feedstock 48 and the heat transfer surfaces 25 and 29 of walls 14 and 16 of vessel 12, mixing blade assembly 40 is provided with scrapers which engage the walls 14 and 16, as the mixing blade assembly 40 is rotated, to scrape accumulated feedstock from the heat transfer surfaces 25 and 29 of the walls 14 and 16 and maintain contact between the circulating feedstock 48 and the heat transfer surfaces 25 and 29 of the walls 14 and 16.

Figure 4:
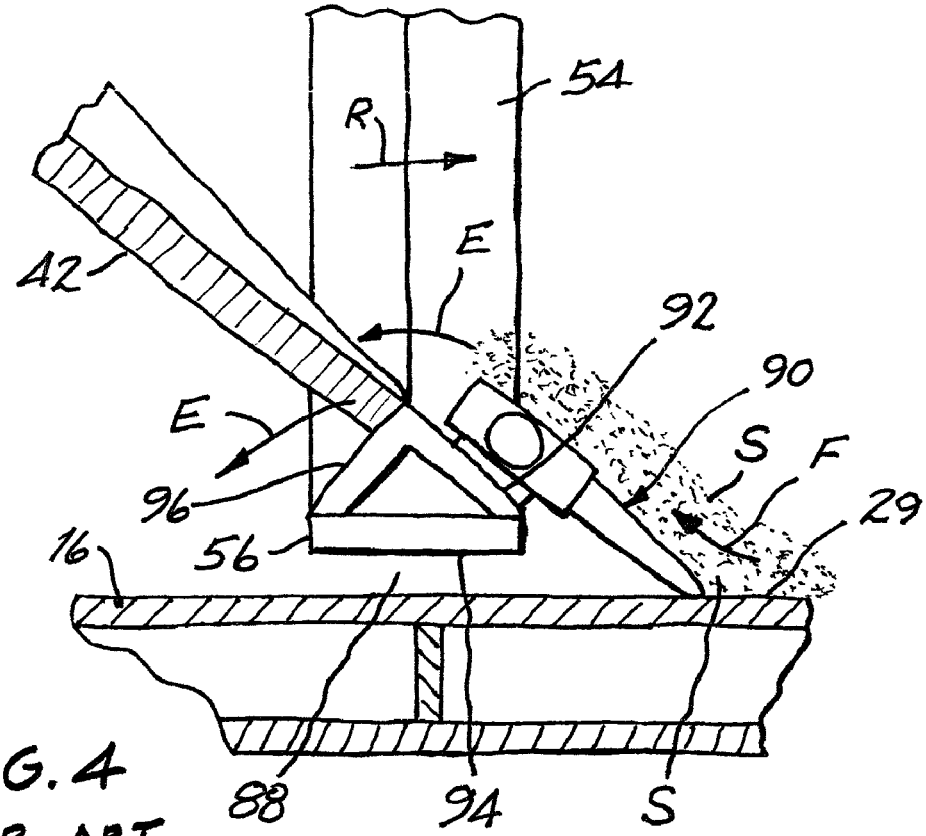
FIG. 4 PRIOR ART
FIG. 4 is an enlarged fragmentary cross-sectional view of a portion of FIG. 2.

As seen somewhat diagrammatically in FIGS. 2 and 4, horizontal support member 56 is spaced from bottom wall 16 by a space 88 and has a triangular cross-sectional configuration, and a bottom scraper blade 90 is carried by the horizontal support member 56, mounted to a leading face 92 of the support member 56, angled to engage the bottom wall 16 and scrape feedstock from the heat transfer surface 29 of the bottom wall 16, and into circulation, as indicated by arrow F. The triangular cross-sectional configuration is oriented with a bottom face 94 of the support member 56 confronting the bottom wall 16, substantially parallel to the bottom wall 16, and following behind the scraper blade 90, while a trailing face 96 of the support member 56 follows behind the leading face 92 and the scraper blade 90. Scraped feedstock material S is a portion of feedstock 48 intercepted by scraper blade 90 ahead of support member 56 and is directed by scraper blade 90 to flow generally upwardly, away from bottom wall 16, and over support member 56, as indicated by arrows E. Thus, little or no feedstock flows through the space 88 between the support member 56 and bottom wall 16.

Figure 5:
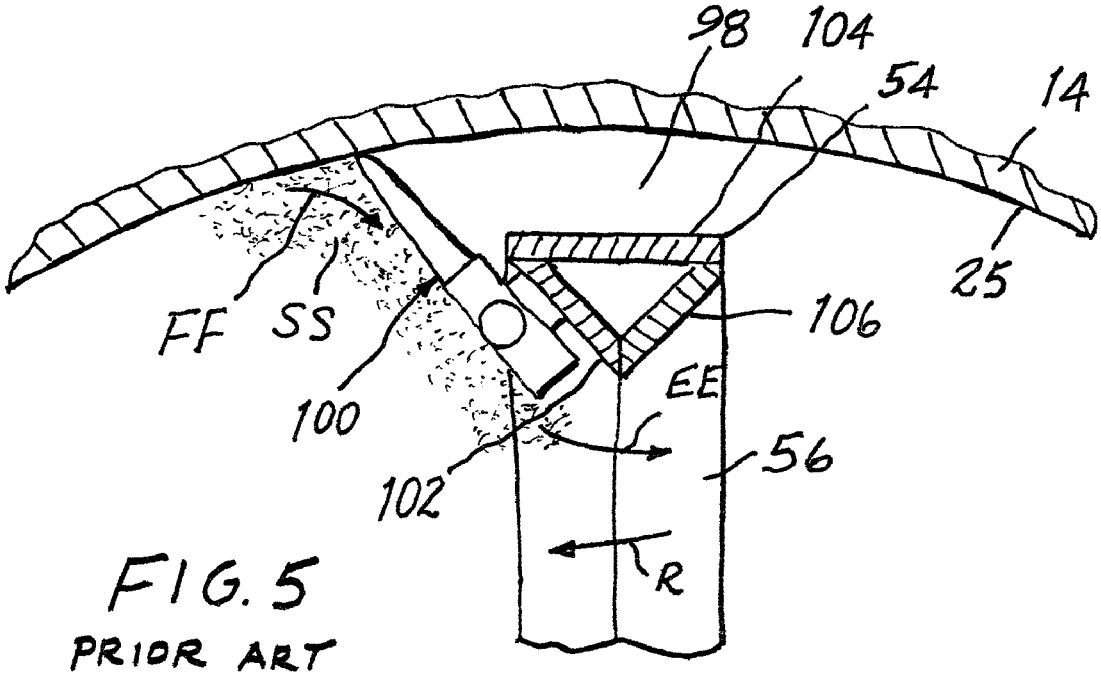
FIG. 5 PRIOR ART
FIG. 5 is an enlarged fragmentary cross-sectional view of a portion of FIG. 3.

In a like manner, as seen somewhat diagrammatically in FIGS. 3 and 5, vertical support member 54 has a triangular cross-sectional configuration spaced from side wall 14 by a space 98. A side scraper blade 100 is carried by the vertical support member 54, mounted to leading face 102 of the support member 54, angled to engage the heat transfer surface 25 of the side wall 14 and scrape feedstock from the heat transfer surface 25 of side wall 14, and into circulation, as indicated by arrow FF. The triangular cross-sectional configuration of the support member 54 is oriented so that a side face 104 of the support member 54 confronts the side wall 14, is substantially parallel to the side wall 14, and follows behind the scraper blade 100, while a trailing face 106 of the support member 54 follows behind the leading face 102 and the scraper blade 100. Scraped feedstock SS is that portion of feedstock 48 intercepted ahead of support member 54 and is directed by scraper blade 100 to flow generally sideways, away from side wall 14, and over support member 54, as indicated by arrows EE. Thus, little or no feedstock 48 flows through the space 98 between the support member 54 and side wall 14.

Turning now to FIGS. 6 through 9, as well as with some reference to FIGS. 1 through 5, another mixing apparatus constructed in accordance with the prior art is shown at 110 and, as before, is seen to include a vessel 112 having a circular cylindrical vertical side wall 114 extending upwardly from a complementary circular horizontal bottom wall 116 to a top end 118. A cylindrical jacket 120 surrounds the side wall 114 and includes vertically arranged chambers 122 for circulating a heat transfer fluid 124 in juxtaposition with side wall 114 and heat transfer surface 125 provided by side wall 114. A circular jacket 126 is juxtaposed with bottom wall 116 and includes horizontally arranged chambers 128 for circulating a heat transfer fluid 130 in juxtaposition with bottom wall 116 and heat transfer surface 129 provided by bottom wall 116.

A mixing blade assembly 140 includes a helical mixing blade 142 and is mounted for rotation within vessel 112, about a central axis of rotation 144, to rotate mixing blade 142 in a direction RR about the central axis of rotation 144 and effect mixing of a batch 146 of feedstock 148 placed within vessel 12. Mixing blade 142 is juxtaposed with side wall 114 and, upon rotation about axis of rotation 144, in the direction RR, effects mixing of the feedstock 148 while driving the feedstock 148 generally upwardly, in a direction from the bottom wall 116 toward the top end 118 of the side wall 114, to circulate the feedstock 148 within the vessel 112.

Mixing blade 142 is carried by a support structure 150 of the mixing blade assembly 140, the support structure 150 including a generally L-shaped frame 152 comprised of a vertical support member 154 and a horizontal support member 156. The mixing blade 142 is affixed, adjacent upper end 158 of the mixing blade 142, to the frame 152, adjacent upper portion 160 of vertical support member 154, and is affixed, adjacent lower end 162 of the mixing blade 142, to the frame 152, adjacent end 164 of horizontal support member 156, as by welding the mixing blade 142 to the frame 152 at each end 158 and 162 of mixing blade 142. The frame 152 is rotated about axis of rotation 144 in a manner similar to that described above in connection with the rotation of frame 52 of mixing blade assembly 40. As before, an additional mixing mechanism is placed within vessel 112, and is shown in the form of a submersible media mill 180 located coaxial with mixing blade assembly 140 and mixing blade 142, the media mill 180 having an inlet at 182 and outlets at an apertured containment wall 184 and at an apertured bottom 186, as is conventional in media mills.

In the operation of mixing apparatus 110, mixing blade assembly 140 is rotated simultaneously with the operation of media mill 180, and feedstock 148 is circulated within vessel 112. Thus, feedstock 148 enters media mill 180 at inlet 182, as indicated by arrows AA, is processed by the media mill 180, and exits through containment wall 184, directed generally toward the side wall 114, as indicated by arrows BB, and exits through bottom 186, directed toward the bottom wall 116 of the vessel 112, as indicated by arrows CC. Helical mixing blade 142 moves the feedstock 148 generally upwardly, as indicated by arrows DD, to once again enter the media mill 180 at inlet 182, again as indicated by arrows AA.

As set forth above, usually feedstock 148 consists of a viscous liquid which contains solid constituents and tends to accumulate along the side wall 114 and the bottom wall 116 of vessel 112. As before, in order to assist in the transfer of heat between the feedstock 148 and the respective heat transfer surfaces 125 and 129 of walls 114 and 116 of vessel 112, mixing blade assembly 140 is provided with scrapers which engage the heat transfer surfaces 125 and 129 of walls 114 and 116, as the mixing blade assembly 140 is rotated, to scrape accumulated feedstock from the walls 114 and 116 and maintain contact between the circulating feedstock 148 and the heat transfer surfaces 125 and 129 of walls 114 and 116. Thus, as seen somewhat diagrammatically in FIGS. 6 and 8, horizontal support member 156 has a polygonal cross-sectional configuration, shown in the form of a triangular cross-sectional configuration, and a bottom scraper blade 190 is carried by the horizontal support member 156.

Support member 156 includes a mixing surface 191 confronting the bottom wall 116 and spaced from heat transfer surface 129, and mixing surface 191 is configured to squeeze feedstock between mixing surface 191 and heat transfer surface 129 as support member 156 is moved forward, in the direction RR, during rotation of frame 152 about axis of rotation 144. To that end, the triangular cross-sectional configuration of support member 156 is oriented with an apex $\delta$ of the triangular cross-sectional configuration confronting the bottom wall 116 so that support member 156 presents a leading face 192 which makes an angle $\alpha$ with the bottom wall 116, and a trailing face 194 which makes an angle $\beta$ with the bottom wall 116. A passage 188 is established between horizontal support member 156 and bottom wall 116.

Scraper blade 190 is mounted upon a bracket 196 carried by horizontal support member 156, the bracket 196 extending rearwardly to space the scraper blade 190 from trailing face 194 in a rearward direction, relative to the direction of rotation RR of the mixing blade assembly 140. With scraper blade 190 engaged with the heat transfer surface 129 of the bottom wall 116 at an angle $\theta$, and apex $\delta$ of the horizontal support member 156 spaced a short distance from the bottom wall 116, feedstock material M adjacent bottom wall 116 passes through an entrance portion 197 of passage 188 where the passage 188 contracts along leading face 192 and, by virtue of angle $\alpha$, is urged into a narrow constriction, shown in the form of a throat T at an intermediate portion of passage 188 where the feedstock material M is squeezed between the apex $\delta$ and the bottom wall 116, forcing the feedstock material M against the bottom wall 116, thereby generating additional shear within the feedstock material M.

As the feedstock material M passes through throat T and then through an exit portion 198 of passage 188 where the passage 188 expands along the trailing face 194, a pressure drop occurs within the feedstock material M, by virtue of angle $\beta$. Thus, the leading face 192 and the trailing face 194 establish portions 197 and 198 of passage 188 which, in combination with the intermediate portion of passage 188 at narrow throat T, act much like a high-energy venturi, creating additional shear in feedstock material M for enhanced mixing. At the same time, the trailing scraper blade 190, spaced rearwardly from trailing face 194, directs the flow of feedstock material M toward the helical mixing blade 142, allowing the mixing blade 142 to pick up the feedstock material M and move mixed feedstock 148 toward the top end 118 of side wall 114, enabling the scraped feedstock material M to be moved in an orderly and predictable manner, rendering the mixed feedstock 148 more uniform and enhancing heat transfer between the feedstock 148 and the heat transfer surface 129 provided by bottom wall 116.

Further, whereas the flow pattern followed in mixing apparatus 10, wherein the direction of flow of scraped feedstock material S, as indicated by arrow F in FIGS. 2 and 4, is counter to the direction of flow of feedstock 48 leaving the media mill 80 through the bottom 86 of the media mill 80, as indicated by arrows C, and causes a disruption in the smooth circulation of feedstock 48 from the media mill 80 to the mixing blade 42, the flow of scraped feedstock material M along the path of travel indicated by arrows P in mixing apparatus 110, as illustrated in FIG. 6, is not counter to the flow of feedstock 148 out of the bottom 186 of the media mill 180, in the direction indicated by arrows CC, thereby facilitating a smooth and uninterrupted circulation of feedstock 148 from the media mill 180 to the mixing blade 142, with a concomitant enhancement of uniformity in the mixed batch of feedstock 148 and heat transfer.

In a like manner, as seen somewhat diagrammatically in FIGS. 7 and 9, vertical support member 154 has a polygonal cross-sectional configuration, shown in the form of a triangular cross-sectional configuration, and a side scraper blade 200 is carried by the vertical support member 154. Support member 154 includes a mixing surface 201 confronting the side wall 114 and spaced from heat transfer surface 125. Mixing surface 201 is configured to squeeze feedstock between mixing surface 201 and heat transfer surface 125 as support member 154 moves forward, in the direction RR, during rotation of frame 152 about axis of rotation 144. To that end, the triangular cross-sectional configuration of support member 154 is oriented with an apex δδ of the triangular cross-sectional configuration confronting the side wall 114 so that support member 154 presents a leading face 202 which makes an angle αα with the side wall 114, and a trailing face 204 which makes an angle ββ with the side wall 114. A passage 205 is established between vertical support member 154 and side wall 114.

Scraper blade 200 is mounted upon a bracket 206 carried by vertical support member 154, the bracket 206 extending rearwardly to space the scraper blade 200 from trailing face 204 in a rearward direction, relative to the direction of rotation RR of the mixing blade assembly 140. With scraper blade 200 engaged with heat transfer surface 125 of the side wall 114 at an angle θθ, and apex δδ of the vertical support member 154 spaced a short distance from the side wall 114, feedstock material MM adjacent side wall 114 passes through an entrance portion 210 of passage 205 where the passage 205 contracts along leading face 202 and, by virtue of angle αα, is urged into a narrow constriction, shown in the form of a throat TT at an intermediate portion of passage 205 where the feedstock material MM is squeezed between the apex δδ and the side wall 114, forcing the feedstock material MM against the side wall 114, thereby generating additional shear within the feedstock material MM.

As the feedstock material MM passes out of throat TT and along an exit portion 212 of passage 205, where the passage 205 expands along the trailing face 204, a pressure drop occurs within the feedstock material MM, by virtue of angle ββ. Thus, the leading face 202 and the trailing face 204 establish portions 210 and 212 of passage 205 which, in combination with the intermediate portion of passage 205 at narrow throat TT, act much like a high-energy venturi, creating additional shear in feedstock material MM for enhanced mixing. At the same time, the trailing scraper blade 200, spaced rearwardly from trailing face 204, directs the feedstock material MM toward the helical mixing blade 142, allowing the mixing blade 142 to pick up the feedstock material MM and move the feedstock material MM toward the top end 118 of side wall 114, enabling the scraped feedstock material MM to be moved in an orderly and predictable manner, rendering the mixed feedstock 148 more uniform and enhancing heat transfer between the feedstock 148 and the heat transfer surface 125 provided by the side wall 114.

Scraper blades 200 and 190 preferably are constructed of a flexible material enabling the scraper blades 200 and 190 to conform closely to the respective side and bottom walls 114 and 116 for effective scraping of feedstock material M and MM.

Referring now to FIGS. 10 through 13, a mixing apparatus constructed in accordance with the present invention is shown at 310 and, as before, is seen to include a vessel 312 having a circular cylindrical vertical side wall 314 extending upwardly from a complementary circular horizontal bottom wall 316 to a top end 318. A cylindrical jacket 320 surrounds the side wall 314 and includes vertically arranged chambers 322 for circulating a heat transfer fluid 324 in juxtaposition with side wall 314 and heat transfer surface 325 provided by side wall 314. A circular jacket 326 is juxtaposed with bottom wall 316 and includes horizontally arranged chambers 328 for circulating a heat transfer fluid 330 in juxtaposition with bottom wall 316 and heat transfer surface 329 provided by bottom wall 316.

A mixing blade assembly 340 includes a helical mixing blade 342 and is mounted for rotation within vessel 312, about a central axis of rotation 344, to rotate mixing blade 342 in a direction of rotation RA about the central axis of rotation 344 and effect mixing of a batch 346 of feedstock 348 placed within vessel 312. Mixing blade 342 is juxtaposed with side wall 314 and, upon rotation about axis of rotation 344, in the direction of rotation RA, effects mixing of the feedstock 348 while driving the feedstock 348 generally upwardly, in a direction from the bottom wall 316 toward the top end 318 of the side wall 314, to circulate the feedstock 348 within the vessel 312.

Mixing blade 342 is carried by a support structure 350 of the mixing blade assembly 340, the support structure 350 including a generally L-shaped frame 352 comprised of a vertical support member 354 and a horizontal support member 356. The mixing blade 342 is affixed, adjacent upper end 358 of the mixing blade 342, to the frame 352, adjacent upper portion 360 of vertical support member 354, and is affixed, adjacent lower end 362 of the mixing blade 342, to the frame 352, adjacent end 364 of horizontal support member 356, as by welding the mixing blade 342 to the frame 352 at each end 358 and 362 of mixing blade 342. The frame 352 is rotated about axis of rotation 344 in a manner similar to that described above in connection with the rotation of frame 52 of mixing blade assembly 40. As before, an additional mixing mechanism is placed within vessel 312, and is shown in the form of a submersible media mill 380 located coaxial with mixing blade assembly 340 and mixing blade 342, the media mill 380 having an inlet at 382 and outlets at an apertured containment wall 384 and at an apertured bottom 386, as is conventional in media mills.

In the operation of mixing apparatus 310, mixing blade assembly 340 is rotated simultaneously with the operation of media mill 380, and feedstock 348 is circulated within vessel 312. Thus, feedstock 348 enters media mill 380 at inlet 382, as indicated by arrows AE, is processed by the media mill 380, and exits through containment wall 384, directed generally toward the side wall 314, as indicated by arrows BE, and exits through bottom 386, directed toward the bottom wall 316 of the vessel 312, as indicated by arrows CE. Helical mixing blade 342 moves the feedstock 348 generally upwardly, as indicated by arrows DU, to once again enter the media mill 380 at inlet 382, again as indicated by arrows AE.

As set forth above, usually feedstock 348 consists of a viscous liquid which contains solid constituents and tends to accumulate along the side wall 314 and the bottom wall 316 of vessel 312. As before, in order to assist in the transfer of heat between the feedstock 348 and the respective heat transfer surfaces 325 and 329 of walls 314 and 316 of vessel 312, mixing blade assembly 340 is provided with scrapers which engage the heat transfer surfaces 325 and 329 of walls 314 and 316, as the mixing blade assembly 340 is rotated, to scrape accumulated feedstock from the walls 314 and 316 and maintain contact between the circulating feedstock 348 and the heat transfer surfaces 325 and 329 of walls 314 and 316. Thus, as seen somewhat diagrammatically in FIGS. 10 and 11, horizontal support member 356 has a polygonal cross-sectional configuration, shown in the form of a triangular cross-sectional configuration, and a bottom or end scraper blade 390 is carried by the horizontal support member 356. Support member 356 includes a mixing surface 391 confronting the bottom wall 316 and spaced from heat transfer surface 329, and mixing surface 391 is configured to squeeze feedstock between mixing surface 391 and heat transfer surface 329 as support member 356 is moved forward, in the direction of rotation RA, during rotation of frame 352 about axis of rotation 344. To that end, the triangular cross-sectional configuration of support member 356 is oriented with an apex 6E of the triangular cross-sectional configuration confronting the bottom wall 316 so that support member 356 presents a leading face 392 which makes an angle αE with the bottom wall 316, and a trailing face 394 which makes an angle βE with the bottom wall 316. A passage 388 is established between horizontal support member 356 and bottom wall 316.

Scraper blade 390 is mounted upon a bracket 396 carried by horizontal support member 356, the bracket 396 extending rearwardly to space the scraper blade 390 from trailing face 394 in a rearward direction, relative to the forward direction of rotation RA of the mixing blade assembly 340. With scraper blade 390 engaged with the heat transfer surface 329 of the bottom wall 316 at an angle θE, and apex δE of the horizontal support member 356 spaced a short distance from the bottom wall 316, feedstock material M adjacent bottom wall 316 passes through an entrance portion 397 of passage 388 where the passage 388 contracts along leading face 392 and, by virtue of angle αE, is urged into a narrow constriction, shown in the form of a throat TE at an intermediate portion of passage 388 where the feedstock material M is squeezed between the apex δE and the bottom wall 316, forcing the feedstock material M against the bottom wall 316, thereby generating additional shear within the feedstock material M.

As the feedstock material M passes through throat TE and then through an exit portion 398 of passage 388 where the passage 388 expands along the trailing face 394, a pressure drop occurs within the feedstock material M, by virtue of angle βE. Thus, the leading face 392 and the trailing face 394 establish portions 397 and 398 of passage 388 which, in combination with the intermediate portion of passage 388 at narrow throat TE, act much like a high-energy venturi, creating additional shear in feedstock material M for enhanced mixing. At the same time, the trailing scraper blade 390, spaced rearwardly from trailing face 394, directs the flow of feedstock material M toward the helical mixing blade 342, allowing the mixing blade 342 to pick up the feedstock material M and move mixed feedstock 348 toward the top end 318 of side wall 314, enabling the scraped feedstock material M to be moved in an orderly and predictable manner, rendering the mixed feedstock 348 more uniform and enhancing heat transfer between the feedstock 348 and the heat transfer surface 329 provided by bottom wall 316.

In a like manner, as seen somewhat diagrammatically in FIGS. 11 and 13, vertical support member 354 has a polygonal cross-sectional configuration, shown in the form of a triangular cross-sectional configuration, and a side scraper blade 400 is carried by the vertical support member 354. Support member 354 includes a mixing surface 401 confronting the side wall 314 and spaced from heat transfer surface 325. Mixing surface 401 is configured to squeeze feedstock between mixing surface 401 and heat transfer surface 325 as support member 354 moves forward, in the direction RA, during rotation of frame 352 about axis of rotation 344. To that end, the triangular cross-sectional configuration of support member 354 is oriented with an apex 6S of the triangular cross-sectional configuration confronting the side wall 314 so that support member 354 presents a leading face 402 which makes an angle αS with the side wall 314, and a trailing face 404 which makes an angle βS with the side wall 314. A passage 405 is established between vertical support member 354 and side wall 314.

Scraper blade 400 is mounted upon a bracket 406 carried by vertical support member 354, the bracket 406 extending rearwardly to space the scraper blade 400 from trailing face 404 in a rearward direction, relative to the direction of rotation RA of the mixing blade assembly 340. With scraper blade 400 juxtaposed with heat transfer surface 325 of the side wall 314 at an angle θS, and apex δS of the vertical support member 354 spaced a short distance from the side wall 314, feedstock material MM adjacent side wall 314 passes through an entrance portion 410 of passage 405 where the passage 405 contracts along leading face 402 and, by virtue of angle αS, is urged into a narrow constriction, shown in the form of a throat TS at an intermediate portion of passage 405 where the feedstock material MM is squeezed between the apex δS and the side wall 314, forcing the feedstock material MM against the side wall 314, thereby generating additional shear within the feedstock material MM.

As the feedstock material MM passes out of throat TS and along an exit portion 412 of passage 405, where the passage 405 expands along the trailing face 404, a pressure drop occurs within the feedstock material MM, by virtue of angle βS. Thus, the leading face 402 and the trailing face 404 establish portions 410 and 412 of passage 405 which, in combination with the intermediate portion of passage 405 at narrow throat TS, act much like a high-energy venturi, creating additional shear in feedstock material MM for enhanced mixing. At the same time, the trailing scraper blade 400, spaced rearwardly from trailing face 404, directs the feedstock material MM toward the helical mixing blade 342, allowing the mixing blade 342 to pick up the feedstock material MM and move the feedstock material MM toward the top end 318 of side wall 314, enabling the scraped feedstock material MM to be moved in an orderly and predictable manner, rendering the mixed feedstock 348 more uniform and enhancing heat transfer between the feedstock 348 and the heat transfer surface 325 provided by the side wall 314.

Scraper blade 390 is mounted for pivotal movement relative to mixing blade assembly 340 about a pivotal axis PE at the bracket 396 that extends rearwardly from horizontal support member 356 so that the scraper blade 390 is placed at a location spaced away from bottom wall 316 and offset rearwardly from the horizontal support member 356 with respect to forward direction RA. Scraper blade 390 has a polygonal cross-sectional configuration, shown in the form of a substantially triangular cross-sectional configuration, and includes a forward face 420 extending from adjacent the pivotal axis PE to a first end scraper edge 422 located at an intersection between forward side 424 and base 426 of the triangular cross-sectional configuration, while the pivotal axis PE is located adjacent apex 430 of the triangular cross-sectional configuration.

Upon rotation of the mixing blade assembly 340 in the forward direction RA, scraper blade 390 is swept, in the forward direction RA, along a path of travel that extends in juxtaposition with the bottom wall 316, by virtue of the spacing of pivotal axis PE from bottom wall 316, and first end scraper edge 422 is urged toward heat transfer surface 329 of the bottom wall 316 in response to engagement of feedstock M with the forward face 420 of scraper blade 390, the forward face 420 being configured and oriented so as to operate in concert with the spacing between pivotal axis PE and bottom wall 316 to effect pivotal movement of the scraper blade 390 to bias the first end scraper edge 422 toward the bottom wall 316 in response to the engagement of feedstock M with the forward face 320 of the scraper blade 390.

In a like manner, scraper blade 400 is mounted for pivotal movement relative to mixing blade assembly 340 about a pivotal axis PS at the bracket 406 that extends rearwardly from vertical support member 354 so that the scraper blade 400 is placed at a location offset rearwardly from the vertical support member 354 with respect to forward direction RA. Scraper blade 400 also has a polygonal cross-sectional configuration, shown in the form of a substantially triangular cross-sectional configuration, and includes a forward face 440 extending from adjacent the pivotal axis PS to a first side scraper edge 442 located at an intersection between forward side 444 and base 446 of the triangular cross-sectional configuration, while the pivotal axis PS located adjacent apex 450 the triangular cross-sectional configuration.

Upon rotation of the mixing blade assembly 340 in the forward direction RA, scraper blade 400 is swept, in the forward direction RA, along a path of travel that extends in juxtaposition with the side wall 314 and, by virtue of the spacing of pivotal axis PS from side wall 314, first side scraper edge 442 is urged toward heat transfer surface 325 of the side wall 314 in response to engagement of feedstock MM with the forward face 440 of scraper blade 400, the forward face 440 being configured and oriented so as to operate in concert with the spacing between pivotal axis PS and side wall 314 to effect pivotal movement of the scraper blade 400 to bias the first side scraper edge 442 toward the side wall 314 in response to the engagement of feedstock MM with the forward face 440 of scraper blade 400.

As seen in FIGS. 14 through 17, upon rotation of the mixing blade assembly 340 in a reverse direction of rotation RB, scraper blade 390 is swept along the path of travel that extends in juxtaposition with the bottom wall 316, in reverse direction RB. Scraper blade 390 includes a second end scraper edge 452 located opposite first end scraper edge 422, at an intersection between rearward side 454 and base 426 of the triangular cross-sectional configuration of scraper blade 390 and, by virtue of the spacing between pivotal axis PE and bottom wall 316, the second end scraper edge 452 is urged toward heat transfer surface 329 of the bottom wall 316 in response to engagement of feedstock M with a rearward face 456 of scraper blade 390, the rearward face 456 being configured and oriented so as to operate in concert with the spacing between the pivotal axis PE and bottom wall 316, to effect pivotal movement of the scraper blade 390 to bias the second end scraper edge 452 toward the bottom wall 316 in response to the engagement of feedstock M with the scraper blade 390.

Likewise, upon rotation of the mixing blade assembly 340 in reverse direction RB, scraper blade 400 is swept along the path of travel that extends in juxtaposition with the side wall 314, in reverse direction RB. A second side scraper edge 462 is located opposite first side scraper edge 442, at an intersection between rearward side 464 and base 446 of the triangular cross-sectional configuration of scraper blade 400 and, by virtue of the spacing between pivotal axis PS and side wall 314, is urged toward heat transfer surface 325 of the side wall 314 in response to engagement of feedstock MM with a rearward face 466 of scraper blade 400, the rearward face 466 being configured and oriented so as to operate in concert with the spacing between pivotal axis PS and side wall 314 to effect pivotal movement of the scraper blade 400 to bias the second side scraper edge 462 toward the side wall 314 in response to the engagement of feedstock MM with the scraper blade 400.

Thus, the scraper blades 390 and 400 are automatically reversed; that is, each scraper blade 390 and 400 is movable between two positions in response to engagement by feedstock during rotation of the mixing blade assembly 340 in the forward and reverse directions. During rotation of the mixing blade assembly 340 in the forward direction of rotation RA, the scraper blades 390 and 400 are pivoted into a first position wherein the respective first scraper edges 422 and 442 are biased toward and retained in juxtaposition with corresponding walls 316 and 314 to scrape feedstock material from the walls 316 and 314 of vessel 312 for directing scraped feedstock material to feedstock being circulated by mixing blade 342. During rotation of the mixing blade assembly 340 in the reverse direction of rotation RB, the scraper blades 390 and 400 automatically are pivoted into a second position wherein the respective second scraper edges 452 and 462 are biased toward and retained in juxtaposition with the corresponding walls 316 and 314 to scrape feedstock material from the walls 316 and 314 of vessel 312 for directing scraped feedstock material to feedstock being circulated by mixing blade 342. The ability to scrape feedstock from the walls 316 and 314 of the vessel 312 during both a forward and a reverse rotation of the mixing blade assembly 340 increases the exposure of the respective heat transfer surfaces 329 and 325, to feedstock being circulated within the vessel 312, thereby enhancing heat exchange. Further, operation of the mixing blade 342 carried by the mixing blade assembly 340 in forward and reverse directions, improves and accelerates mixing, especially when mixing a feedstock of higher viscosity. In addition, rotation of the mixing blade assembly 340 in the reverse direction accomplishes a cleaning cycle by virtue of the establishment of a reverse flow of feedstock that enables the feedstock to capture particulate constituents that may accumulate on certain surfaces of the mixing blade assembly 340, as well as the mixing blade 342 itself, during forward rotation of the mixing blade assembly 340, which constituents might otherwise not be exposed to circulating feedstock, thereby increasing the efficiency and effectiveness of a mixing operation.

In the embodiment illustrated in FIGS. 18 through 20, end scraper blade 390 has been replaced by end scraper blade 500 mounted beneath horizontal support member 356 for pivotal movement relative to mixing blade assembly 340 about a pivotal axis PEA. Scraper blade 500 has a polygonal cross-sectional configuration, preferably in the form of a substantially triangular cross-sectional configuration, similar to the cross-sectional configuration of scraper blade 390, and includes a forward face 520 extending from adjacent the pivotal axis PEA to a first end scraper edge 522, while the pivotal axis PEA is located adjacent apex 530 of the triangular cross-sectional configuration.

Upon rotation of the mixing blade assembly 340 in the forward direction RA, scraper blade 500 is swept, in the forward direction RA, along a path of travel that extends in juxtaposition with the bottom wall 316, by virtue of the spacing of pivotal axis PEA from bottom wall 316, and first end scraper edge 522 is urged toward the bottom wall 316 in response to engagement of feedstock with the forward face 520 of scraper blade 500, the forward face 520 being configured and oriented so as to operate in concert with the spacing between pivotal axis PEA and bottom wall 316 to effect pivotal movement of the scraper blade 500 to bias the first end scraper edge 522 toward the bottom wall 316 in response to the engagement of feedstock with the forward face 520 of the scraper blade 500.

Upon rotation of the mixing blade assembly 340 in a reverse direction of rotation RB, scraper blade 500 is swept along the path of travel that extends in juxtaposition with the bottom wall 316, in reverse direction RB. Scraper blade 500 includes a second end scraper edge 552 located opposite first end scraper edge 522 and, by virtue of the spacing between pivotal axis PEA and bottom wall 316, the second end scraper edge 552 is urged toward the bottom wall 316 in response to engagement of feedstock with a rearward face 556 of scraper blade 500, the rearward face 556 being configured and oriented so as to operate in concert with the spacing between the pivotal axis PEA and bottom wall 316, to effect pivotal movement of the scraper blade 500 to bias the second end scraper edge 552 toward the bottom wall 316 in response to the engagement of feedstock with the scraper blade 500.

However, in contrast to the arrangement in the embodiment illustrated in FIG. 15, wherein two opposite end scraper blades 390 are mounted upon horizontal support member 356 for pivotal movement about respective pivotal axes PE that extend parallel to horizontal support member 356, the embodiment of FIGS. 18 through 20 includes single end scraper blade 500 mounted upon horizontal support member 356 for pivotal movement about pivotal axis PEA extending in an end scraper direction ED that makes an acute angle 560 with radial direction RD in which the horizontal support member 356 extends from the central axis of rotation 344. In the preferred construction, acute angle 560 is within a range of about eight to twelve degrees. By orienting the end scraper blade 500 so as to extend along end scraper direction ED, a portion 562 of end scraper blade 500, located adjacent inner end 564 of end scraper blade 500, is placed beneath horizontal support member 356 so as to be overlapped by horizontal support member 356, thereby lending stability to end scraper blade 500 relative to horizontal support member 356 upon set-up and operation of mixing apparatus 310. At the same time, acute angle 560 places opposite outer end 566 of end scraper blade 500 rearward of horizontal support member 356, with respect to rotation of the mixing blade assembly 340 in the forward direction of rotation RA, adjacent side wall 314. The central axis of rotation 344 lies between the outer and inner ends 566 and 564 of the end scraper blade 500, adjacent inner end 564, so that upon rotation of the mixing blade assembly 340 about the central axis of rotation 344, end scraper blade 500 will sweep across the entire area of end wall 316.

It will be seen that the present invention attains all of the objects and advantages summarized above, namely: Provides a mixing blade assembly placed within a mixing vessel and carrying scraper blades that effect scraping of feedstock from walls of the mixing vessel during movement of the mixing blade assembly, and the scraper blades, in both a forward direction and a reverse direction to increase the effectiveness of the mixing blade assembly in mixing a batch of feedstock in the mixing vessel; facilitates heat transfer between a batch of feedstock and the walls of the vessel within which the feedstock is mixed, for attaining increased uniformity throughout the batch in less mixing time; reduces resistance to efficient circulation of feedstock within a batch of feedstock being mixed in a mixing vessel, with a concomitant reduction of energy needed to complete a mixing operation; provides a mixing blade assembly placed within a mixing vessel with an additional mixing mechanism, which mixing blade assembly is constructed to interact with the additional mixing mechanism to assist in circulating feedstock within the batch for increased effectiveness of both the mixing blade assembly and the additional mixing mechanism; attains a more uniform mixture within a batch of feedstock in less time and with the consumption of less energy; simplifies the maintenance of a mixing blade assembly for economical long-term operation; provides a rugged mixing blade assembly capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A mixing apparatus for mixing constituents of a feedstock, the mixing apparatus comprising:

a vessel for containing feedstock, the vessel having a vessel wall, the vessel wall including a side wall and an end wall, a side wall surface extending along the side wall for being engaged by the feedstock as the constituents of the feedstock are mixed within the vessel, and an end wall surface extending along the end wall for being engaged by the feedstock as the constituents of the feedstock are mixed within the vessel;

a mixing blade assembly including a mixing blade, the mixing blade assembly being adapted to rotate within the vessel, about an axis of rotation, in either one of a forward direction of rotation and a reverse direction of rotation wherein the mixing blade will circulate feedstock within the vessel, the mixing blade assembly including an end mixing blade support member spaced from the end wall surface and extending along a radial direction between the axis of rotation and the side wall;

a side scraper blade carried by the mixing blade assembly for sweeping along a side path of travel extending in juxtaposition with the side wall surface, the side scraper blade having opposite first and second side scraper edges and being mounted upon the mixing blade assembly for movement relative to the mixing blade assembly, the side scraper blade being configured such that upon rotation of the mixing blade assembly in the forward direction of rotation, the side scraper blade will be moved relative to the mixing blade assembly, in response to engagement with feedstock, into a first position wherein the first side scraper edge of the side scraper blade is juxtaposed with the side wall surface to scrape feedstock material from the side wall surface for direction of scraped feedstock material by the side scraper blade to feedstock being circulated by the mixing blade, and in the reverse direction of rotation, the side scraper blade will be moved relative to the mixing blade assembly, in response to engagement by feedstock into a second position wherein the second side scraper edge of the side scraper blade is juxtaposed with the side wall surface to scrape feedstock material from the side wall surface for direction of scraped feedstock material by the side scraper blade to feedstock being circulated by the mixing blade; and an end scraper blade carried by the mixing blade assembly for sweeping along an end path of travel extending in juxtaposition with the end wall surface, the end scraper blade having opposite first and second end scraper edges and being mounted upon the end mixing blade support member for movement relative to the mixing blade assembly, the end scraper blade being configured such that upon rotation of the mixing blade assembly in the forward direction of rotation, the end scraper blade will be moved relative to the mixing blade assembly, in response to engagement with feedstock, into a first position wherein the first end scraper edge of the end scraper blade is juxtaposed with the end wall surface to scrape feedstock material from the end wall surface for direction of scraped feedstock material by the end scraper blade to feedstock being circulated by the mixing blade, and upon rotation of the mixing blade assembly in the reverse direction of rotation, the end scraper blade will be moved relative to the mixing blade assembly, in response to engagement with feedstock, into a second position wherein the second end scraper edge of the end scraper blade is juxtaposed with the end wall surface to scrape feedstock material from the end wall surface for direction of scraped feedstock material by the end scraper blade to feedstock being circulated by the mixing blade, the end scraper blade extending from an inner end adjacent the axis of rotation to an outer end juxtaposed with the side wall surface, along an end scraper direction making an acute angle with the radial direction.

2. The mixing apparatus of claim 1 wherein the side wall has a circular cylindrical configuration, and the end wall has a complementary circular configuration.

3. The mixing apparatus of claim 2 wherein the axis of rotation comprises a central axis of rotation.

4. The mixing apparatus of claim 3 wherein the mixing blade has a helical configuration for sweeping in juxtaposition with the side wall of the vessel upon rotation of the mixing blade assembly in the forward and reverse directions of rotation.

5. The mixing apparatus of claim 2 wherein the side wall surface comprises a side wall heat exchange surface, and the end wall surface comprises an end wall heat exchange surface.

6. The mixing apparatus of claim 1 wherein each of the side and end scraper blades is mounted upon the mixing blade assembly for pivotal movement between respective first and second positions, about a corresponding pivotal axis located intermediate corresponding first and second side and end scraper edges.

7. The mixing apparatus of claim 6 wherein each of the side and end scraper blades has a polygonal cross-sectional configuration including a forward face extending from adjacent a corresponding pivotal axis to a respective first side scraper edge and first end scraper edge, and a rearward face extending from adjacent the corresponding pivotal axis to a respective second side scraper edge and second end scraper edge, each pivotal axis being spaced away from a respective side wall surface and end wall surface, and each forward face being located between a corresponding pivotal axis and a respective side wall surface and end wall surface and configured and oriented so as to be engaged by feedstock during rotation of the mixing blade assembly in forward directions of rotation for pivotal movement of the side scraper blade and the end scraper blade into and retention of the side scraper blade and the end scraper blade at respective first positions in response to engagement by feedstock, and each rearward face being located between a corresponding pivotal axis and a respective side wall surface and end wall surface and configured and oriented so as to be engaged by feedstock during rotation of the mixing blade assembly in reverse directions of rotation for pivotal movement of the side scraper blade and the end scraper blade into and retention of the side scraper blade and the end scraper blade at respective second positions in response to engagement by feedstock.

8. The mixing apparatus of claim 7 wherein each polygonal cross-sectional configuration is substantially triangular, having a base adjacent a respective side wall surface and end wall surface, a forward side along which a respective forward face extends and a rearward side along which a respective rearward face extends, respective forward and rearward sides converging toward a corresponding apex opposite a corresponding base and adjacent a respective pivotal axis, and respective first and second side and end scraper edges each being located at an intersection between a corresponding base and a respective one of corresponding forward and rearward sides.

9. The mixing apparatus of claim 1 wherein the acute angle is about eight to twelve degrees.

10. A mixing apparatus for mixing constituents of a feedstock, the mixing apparatus comprising:

a vessel for containing feedstock, the vessel having a vessel wall, the vessel wall including a side wall and an end wall, a side wall surface extending along the side wall for being engaged by the feedstock as the constituents of the feedstock are mixed within the vessel, and an end wall surface extending along the end wall for being engaged by the feedstock as the constituents of the feedstock are mixed within the vessel;

a mixing blade assembly including a mixing blade, the mixing blade assembly being adapted to rotate within the vessel, about an axis of rotation, in either one of a forward direction of rotation and a reverse direction or rotation, wherein the mixing blade will circulate feedstock within the vessel, the mixing blade assembly including an end mixing blade support member spaced from the end wall surface and extending along a radial direction between the axis of rotation and the side wall; and an end scraper blade carried by the end mixing blade support member, between the end mixing blade support member and the end wall surface, for sweeping along an end path of travel extending in juxtaposition with the end wall surface, the end scraper blade having opposite first and second end scraper edges and being mounted upon the mixing blade assembly for movement relative to the mixing blade assembly, the end scraper blade being configured such that upon rotation of the mixing blade assembly in the forward direction of rotation, the end scraper blade will be moved relative to the mixing blade assembly, in response to engagement with feedstock, into a first position wherein the first end scraper edge of the end scraper blade is juxtaposed with the end wall surface to scrape feedstock material from the end wall surface for direction of scraped feedstock material by the end scraper blade to feedstock being circulated by the mixing blade, and upon rotation of the mixing blade assembly in the reverse direction of rotation, the end scraper blade will be moved relative to the mixing blade assembly, in response to engagement with feedstock, into a second position wherein the second end scraper edge of the end scraper blade is juxtaposed with the end wall surface to scrape feedstock material from the end wall surface for direction of scraped feedstock material by the end scraper blade to feedstock being circulated by the mixing blade, the end scraper blade extending from an inner end adjacent the axis of rotation to an outer end juxtaposed with the side wall surface, along an end scraper direction making an acute angle with the radial direction.

11. The mixing apparatus of claim 10 wherein the acute angle is about eight to twelve degrees.

12. The mixing apparatus of claim 10 wherein at least a portion of the end scraper blade adjacent the inner end is overlapped by the end mixing blade support member for being placed between the end mixing blade support member and the end wall surface.

13. The mixing apparatus of claim 12 wherein the acute angle is about eight to twelve degrees.

14. The mixing apparatus of claim 10 wherein the outer end is spaced rearwardly from the radial direction with respect to the forward direction of rotation.

15. The mixing apparatus of claim 10 wherein the end scraper blade is mounted upon the mixing blade assembly for pivotal movement between first and second positions, about a pivotal axis located intermediate the first and second end scraper edges.

16. The mixing apparatus of claim 15 wherein the end scraper blade has a polygonal cross-sectional configuration including a forward face extending from adjacent a pivotal axis to a the first end scraper edge, and a rearward face extending from adjacent the pivotal axis to the second end scraper edge, the pivotal axis being spaced away from the end wall surface, and the forward face being located between the pivotal axis and the end wall surface and configured and oriented so as to be engaged by feedstock during rotation of the mixing blade assembly in forward directions of rotation for pivotal movement of the end scraper blade into and retention of the end scraper blade at the first position in response to engagement by feedstock, and the rearward face being located between the pivotal axis and the end wall surface and configured and oriented so as to be engaged by feedstock during rotation of the mixing blade assembly in reverse directions of rotation for pivotal movement of the end scraper blade into and retention of the end scraper blade at the second position in response to engagement by feedstock.

17. The mixing apparatus of claim 16 wherein the polygonal cross-sectional configuration is substantially triangular, having a base adjacent the end wall surface, a forward side along which the forward face extends and a rearward side along which the rearward face extends, forward and rearward sides converging toward an apex opposite the base and adjacent the pivotal axis, and first and second end scraper edges each being located at an intersection between the base and a respective one of the forward and rearward sides.

18. The mixing apparatus of claim 17 wherein the axis of rotation comprises a central axis of rotation and the mixing blade has a helical configuration for sweeping in juxtaposition with the side wall of the vessel upon rotation of the mixing blade assembly in the forward and reverse directions of rotation.

19. The mixing apparatus of claim 10 wherein the side wall has a circular cylindrical configuration, and the end wall has a complementary circular configuration.

20. The mixing apparatus of claim 19 wherein the axis of rotation comprises a central axis of rotation.

21. The mixing apparatus of claim 20 wherein the mixing blade has a helical configuration for sweeping in juxtaposition with the side wall of the vessel upon rotation of the mixing blade assembly in the forward and reverse directions of rotation.

22. The mixing apparatus of claim 21 wherein the acute angle is about eight to twelve degrees.

23. A method for mixing constituents of a feedstock within a vessel wherein the feedstock is engaged with a wall surface within the vessel as the constituents of the feedstock are mixed within the vessel, the method comprising:

rotating a mixing blade assembly within the vessel, about an axis of rotation, in either one of a forward direction of rotation and a reverse direction of rotation to circulate feedstock within the vessel, the mixing blade assembly having a mixing blade, and a mixing blade support member extending in a radial direction from the axis of rotation; and coupling a scraper blade with the mixing blade support member for sweeping the scraper blade along a path of travel extending in juxtaposition with the wall surface upon rotation of the mixing blade assembly in either one of the forward and reverse directions of rotation, the scraper blade having opposite first and second scraper edges;

the scraper blade being movable relative to the mixing blade support member and being configured such that upon rotation of the mixing blade assembly in the forward direction of rotation, the scraper blade is moved relative to the mixing blade assembly, in response to engagement with feedstock, into a first position wherein the first scraper edge of the scraper blade scrapes feedstock material from the wall surface for direction of scraped feedstock material by the scraper blade to feedstock being circulated by the mixing blade, and upon rotation of the mixing blade assembly in the reverse direction of rotation, the scraper blade is moved relative to the mixing blade assembly, in response to engagement with feedstock, into a second position wherein the second scraper edge of the scraper blade scrapes feedstock material from the wall surface for direction of scraped feedstock material by the scraper blade to feedstock being circulated by the mixing blade, the scraper blade being coupled with the mixing blade support member for pivotal movement between the first and second positions about a pivotal axis extending at an acute angle to the radial direction, in response to engagement with feedstock.

24. The method of claim 23 wherein the acute angle is about eight to twelve degrees.

* * * * *